US009502228B2

(12) United States Patent
Jiang et al.

(10) Patent No.: US 9,502,228 B2
(45) Date of Patent: Nov. 22, 2016

(54) ION TRAP ANALYZER AND ION TRAP MASS SPECTROMETRY ANALYSIS METHOD

(71) Applicant: SHIMADZU CORPORATION, Kyoto-shi, Kyoto (CN)

(72) Inventors: Gongyu Jiang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/389,516

(22) PCT Filed: Mar. 26, 2013

(86) PCT No.: PCT/CN2013/000345
§ 371 (c)(1),
(2) Date: Sep. 30, 2014

(87) PCT Pub. No.: WO2013/143349
PCT Pub. Date: Oct. 3, 2013

(65) Prior Publication Data

US 2015/0303047 A1 Oct. 22, 2015

(30) Foreign Application Priority Data

Mar. 31, 2012 (CN) ..... 2012 1 0093413

(51) Int. Cl.
*H01J 49/42* (2006.01)

(52) U.S. Cl.
CPC ..... *H01J 49/4225* (2013.01); *H01J 49/423* (2013.01); *H01J 49/427* (2013.01);
(Continued)

(58) Field of Classification Search
CPC ..... H01J 49/424; H01J 49/422; H01J 49/26; H01J 49/0063; H01J 49/0081;
(Continued)

(56) References Cited

U.S. PATENT DOCUMENTS 5,438,195 A * 8/1995 Franzen ..... H01J 49/4285 250/282
5,710,427 A 1/1998 Schubert et al.
(Continued)

FOREIGN PATENT DOCUMENTS

CN 101320016 A 12/2008
CN 102231356 A 11/2011

OTHER PUBLICATIONS

International Search Report for PCT/CN2013/000345 dated Jul. 4, 2013.

*Primary Examiner* — Wyatt Stoffa
(74) *Attorney, Agent, or Firm* — Sughrue Mion, PLLC

(57) ABSTRACT

An ion trap analyzer, an ion trap mass spectrometry analysis method, and an ion fragmentation method are provided. The ion trap analyzer includes an ion trapping space enclosed by multiple electrodes (101, 102, 103, 11, 12, 214), where a high-frequency voltage is applied on at least a part of the electrodes, so as to generate, within the trapping space, a trapping electric field dominated by a quadratic field. The apparatus is provided with an ion ejection outlet (200) in at least one direction away from the center of the trap; an alternating voltage signal used for resonant excitation of ion motions is overlaid on an electrode part that is on a side of the ion ejection outlet and closest to the ejection outlet, while no voltage signal that is identical in range and phase with the alternating voltage is applied on at least one remaining electrode part in said direction. With the method, or by further applying, to the remaining electrode part in said direction, a voltage signal that is inverted to the alternating
(Continued)

voltage, the orientation of an alternating electric field induced by the excitation alternating voltage signal can be limited, thereby improving the resonance ejection efficiency of the ion trap, reducing, in ion motions, motion coupling between an ejection direction and a non-ejection direction, and improving the viability of selecting the ion trap as a mass analyzer.

14 Claims, 14 Drawing Sheets

(52) U.S. Cl.
CPC ..... *H01J 49/4285* (2013.01); *H01J 49/422* (2013.01); *H01J 49/424* (2013.01); *H01J 49/4245* (2013.01)

(58) Field of Classification Search
CPC ..... H01J 49/4265; H01J 49/4285; H01J 49/4225; H01J 49/423; H01J 49/427; H01J 49/4245
See application file for complete search history.

(56) References Cited

U.S. PATENT DOCUMENTS 6,075,244 A * 6/2000 Baba ..... H01J 49/423 250/281
6,608,303 B2 * 8/2003 Amy ..... H01J 49/424 250/292
7,279,681 B2 * 10/2007 Li ..... H01J 49/4225 250/292
7,285,773 B2 * 10/2007 Ding ..... H01J 49/424 250/282
2002/0185596 A1 * 12/2002 Amy ..... H01J 49/424 250/292
2005/0061966 A1 * 3/2005 Ding ..... H01J 49/424 250/288
2005/0121609 A1 * 6/2005 Makarov ..... B82Y 30/00 250/290
2005/0145790 A1 * 7/2005 Wang ..... H01J 49/424 250/292
2007/0075239 A1 * 4/2007 Ding ..... H01J 49/429 250/282
2007/0138386 A1 * 6/2007 Makarov ..... H01J 49/0054 250/288
2008/0258053 A1 * 10/2008 Makarov ..... H01J 49/004 250/283
2009/0032698 A1 2/2009 Furuhashi et al.
2009/0127456 A1 * 5/2009 Makarov ..... H01J 49/022 250/290
2009/0146054 A1 6/2009 Rafferty
2009/0321624 A1 * 12/2009 Fang ..... H01J 49/004 250/281
2012/0248307 A1 * 10/2012 Ding ..... H01J 49/423 250/293
2013/0099137 A1 * 4/2013 Rafferty ..... H01J 49/26 250/489

* cited by examiner

ION TRAP ANALYZER AND ION TRAP MASS SPECTROMETRY ANALYSIS METHOD

CROSS REFERENCE TO RELATED APPLICATIONS

This application is a National Stage of International Application No. PCT/CN2013/000345 filed Mar. 26, 2013, claiming priority based on Chinese Patent Application No. 201210093413.X filed Mar. 31, 2012, the contents of all of which are incorporated herein by reference in their entirety.

BACKGROUND

1. Technical Field

The present invention relates to a technology of performing mass spectrometry analysis on ions by using an ion trap, and in particular, to an ion trap analyzer optimized by an auxiliary excitation electric field.

2. Related Art

Since 1953 when Paul invented the three-dimensional quadrupole ion trap technology, as an important part of the mass spectrometry technology, ion traps together with related mass spectrometry technologies are widely used in qualitative and quantitative testing of trace materials and material structure information testing based on fragment dissociation spectra, and are used as ion flow modulation apparatuses of other high-definition pulse ion mass analyzers because the ion traps can keep a large amount of ions under test trapped therein for a long time and eject the ions in a short time to produce a concentration effect. In the history of ion trap apparatuses, the dipole resonance auxiliary excitation mode, as the most important invention, plays a key role in improving the mass resolution performance of an ion trap mass analyzer. In this method, a dipole electric field component is overlaid in an original trapping electric field of the ion trap to improve the orientation of ion ejection, and by means of resonance between an overall motion frequency, namely, a secular motion frequency, of the inherent motion frequency of ions and a frequency of the excitation electric field, the motion range of target ions rises rapidly in a short time during a mass-unstable scanning process, thereby reducing the ejection delay and random collision, which comes along with the ejection delay, between target ions and neutral molecules. Compared with the previous boundary ejection mode which only uses the ion stability condition in a radio frequency (RF) trapping electric field, the dipole resonance auxiliary excitation mode significantly improves the ion ejection efficiency and mass resolution capability. This method has become an indispensable basic technology for commercial analytical instruments of ion trap types.

The dipole resonant excitation mode has been officially applied to commercial instruments since late 1980s. As shown in FIG. 1*a*, in a 1988 US patent, Syka et al. from Finnigan proposed a three-dimensional rotating ion trap that includes a ring electrode 101 and a pair of end cap electrodes 102 and 103, where an RF voltage V104 can be applied on the ring electrode 101 to generate a quadrupole field, so as to trap ions in two dimensions, namely, a radial direction R and an axial direction, and a dipole alternating voltage V105 is applied between two end caps to excite ions and eject ions selectively, thereby implementing mass scanning. The voltage can also be used as a means to excite the motion range of ions in an applying direction of the alternating voltage, namely, a direction Z, so that the ions collide with other neutral molecules in the ion trap and are broken into fragmented ions. Using the dipole excitation mode to expand an analytical mass-to-charge ratio range of the ion trap has been proposed before. In the dipole excitation mode, a beta value required during ion ejection, that is, a ratio of a double of a secular motion frequency to a frequency of a trapping RF voltage, can be less than 1. Therefore, for ions that are identical in mass-to-charge ratio, the q parameter of an ion ejected in the dipole excitation mode is smaller. In a voltage scanning mode, a smaller q parameter corresponds to a lower ion trapping voltage. Therefore, with the same RF amplitude scanning parameter, a larger mass-to-charge ratio scanning range can be obtained.

People also proposed a two-dimensional linear ion trap to improve the storage capacity of a three-dimensional ion trap. Such an ion trap structure still uses an RF voltage as a trapping voltage. As shown in FIG. 1*b* ,the ion trap has two pairs of main electrodes 11 and 12 in the direction X and the direction Y. An RF power supply 14 applies high-frequency driving voltages 14.1 and 14.2 that are inverted to each other on the two pairs of main electrodes 11 and 12, so as to form a radial trapping electric field. Ions are generally introduced from one end along the Z axis, and trapped by the electric field in a linear area between the two pairs of electrodes in the X axis and the Y axis. Axial trapping of ions can be implemented relying on an end electrode structure that applies a high potential or by segmenting the main electrodes into multiple sectors and applying a DC trapping bias voltage between sectors. A dipole resonant excitation mode of the two-dimensional linear ion trap is generally implemented by overlaying a dipole excitation voltage in the direction X of the ion trap, where a generator power supply 15 of the voltage is usually overlaid on a main electrode 11.1 on one side of the direction X, while a dipole excitation voltage that is inverted to the voltage on the main electrode 11.1 is overlaid on a main electrode 11.2 on the other side. In this manner, ions can be resonantly excited selectively according to their mass, ejected from a slit 13 between the electrodes in the direction X, and detected by an ion detector installed on the electrode side in the direction X; therefore, mass scanning is implemented.

The resonant dipole excitation mode not only applies to the quadrupole RF ion trap, but also applies to a quadrupole ion trap that uses a static electric field to trap ions, such as the Penning ion trap that traps ions by using a quadrupole static electric field and a static magnetic field jointly, and the currently commercialized Orbitrap that traps ions by using a quadrupole logarithmic field. These different ion traps have a common feature that in an ion excitation or ejection direction X, a function of a trapping potential component applied on ions is $V(x)=Ax^2$; in other words, the field in this direction is a quadratic field, or called a harmonic trap function for short. The secular motion frequency of ions is independent from the resonance amplitude in this direction. Therefore, by applying an excitation alternating electric field whose frequency is the same as a secular frequency of a specific ion trap, a motion-range resonant excitation process of ions can be enabled.

In an ion ejection process of various quadrupole ion traps, a fringing field near an ejection hole has negative influence on simultaneity of ion ejection. Generally, such influence can be indicated by a negative high-order field. That is, when the series of a harmonic function of a pseudo potential of a trap space is expressed as an expansion $\Sigma A_n \mathrm{Re}(x+yi)^n$, if the value of n is large (for example, n>5), $A_n$ will be a negative value due to the said hole, where x is the ion ejection direction, and y is a direction orthogonal to the ejection direction. In the expansion, the term $A_2$ is a quadrupole field component, and the term $A_n$ is a 2n-pole field component. For an ideal quadrupole ion trap, the expansion of the harmonic function in the ejection direction only includes the term $A_2$, so the ion trapping potential field V(x) in this direction is essentially a quadratic electric field $V(x)=A_2x^2$. The ejection outlet can be regarded as a structural deficiency of the RF trapping electrode in the ion ejection direction. In the ion ejection direction, the ion motion is affected by the negative high-order field, which damages the ejection simultaneity of ions having the same mass-to-charge ratio. Such damage is mainly caused by the fact that when the vibration amplitude of ions increases, the restoring force sensed by on the ions is smaller than the force of the simple harmonic potential trap due to the existence of the high-order negative field, and consequently, the resonance frequency of the ions has a red shift, and the resonance of ion motions is detuned.

For many years, people enhance the working performance of the ion trap mainly by improving the field pattern of the trapping electric field. The most direct methods to change the field pattern of the trapping electric field are to modify a boundary structure of a confining electrode of an ion trap. In these methods, the confining electrode in the ejection direction relatively protrudes at the ion ejection outlet, and examples are the solution proposed by Kawato in U.S. Pat. No. 6,087,658, and the method of stretching spacing between confining electrodes in the ejection direction relative to the boundary condition of the ideal quadrupole field.

The trapping electric field may also be improved by dividing the original confining electrode into multiple discrete electrode parts and applying trapping voltages of different amplitudes on these electrode parts. For a three-dimensional ion trap, the inventor of the U.S. Pat. No. 5,468,958 designs a structure having multiple ring electrodes. As shown in FIG. 2*a*, RF trapping voltages of different proportions are applied on multiple ring electrodes, the proportions of the RF voltages are adjusted by a voltage-dividing capacitor network, and the field pattern can be optimized according to requirements during the experiment. Similarly, for the linear ion trap, Ding Chuanfan designed a linear ion trap enclosed by printed circuit boards in Chinese Patent No. CN1585081. As shown in FIG. 2*b*, the structure includes multiple discrete adjustable electrode strip patterns, and bounding RF voltages and bounding DC voltages among these electrode patterns are adjusted by a voltage-dividing capacitor-resistor network. As pointed out by Li Gangqiang et al. in the U.S. Pat. No. 7,755,040, a similar method can also be used to construct a static ion trap with an axial quadratic field shown in FIG. 2*c*.

In addition, the trapping electric field may also be adjusted by adding a correction electrode. For example, in U.S. Pat. No. 7,279,681, it is proposed to insert a correction electrode in an end cap electrode, and by adjusting the voltage amplitude on the correction electrode, the field pattern in a small area near the ejection hole is optimized. Similarly, in the U.S. Pat. No. 6,608,303, it is proposed to solve the defect of the electric field near the ejection hole by changing the RF voltage phase of the correction electrode added at the ejection outlet.

However, all of the above electric field correction technologies rely on the fact that the voltage can be adjusted by a precisely controlled high-voltage trapping power supply. Such high-voltage power supply may be one commonly called RF resonant power supply, or a high-frequency switch power supply used by a digital ion trap, or may further be a DC power supply in the case of a static ion trap. In any case, the added high-voltage power supply increases the complexity of an instrument; especially, when these high-voltage power supplies are expected to be adjusted discretely, the circuits thereof are even more complex.

SUMMARY

Different from the prior art described above, an objective of the present invention is to correct, mainly by limiting an applying range of an alternating excitation voltage, a field pattern of an excitation electric field formed by the excitation voltage, so that the excitation voltage is mainly applied on an area near an ejection outlet of a confining electrode in a direction of the ejection outlet. For other electrode parts in this direction, no resonant excitation voltage signal that has the same phase as the alternating excitation voltage is applied. Therefore, the amplitude of the excitation voltage increases rapidly near the ion ejection outlet, so that ions having a large enough ion motion range are directly accelerated, resonate, and are ejected when getting close to the ejection outlet of the ion trap; because resonance of the ions is not detuned by the negative high-order field near the ejection outlet, the motion range of the ions is not reduced, and no random ejection delay occurs. Therefore, the mass resolution performance of an ion trap mass analyzer using the technology of the present invention is improved.

The advantage as compared with the prior art lies in that: compared with an RF trapping voltage which easily reaches thousands of volts, the excitation voltage generally requires a small voltage amplitude (generally less than 50 V, and usually less than 10 V); therefore, the amplitude adjustment of the excitation voltage can be directly initiated by a medium speed digital-to-analog converter, and implemented by using a medium-speed operational amplifier integrated circuit and by amplifying the voltage along with the current, which, compared with the adjustment of a high trapping voltage, reduces circuit and commissioning complexity for overall voltage adjustment caused by nonlinearity of a high-voltage amplification circuit and various devices under a high voltage, and therefore, also reduces power consumption.

An ion trap analyzer of the present invention includes multiple confining electrodes, the multiple confining electrodes enclose an ion trapping space that serves as an ion trap, where a trapping voltage is applied on at least one confining electrode of the multiple confining electrodes, so as to generate a trapping electric field in the ion trap; a boundary of the ion trapping space is provided with at least one ion ejection outlet; the ion ejection outlet determines an ion ejection direction; confining electrodes on the same side with the ion ejection outlet are divided, in a direction perpendicular to the ion ejection direction, into multiple electrode parts; in at least partial time of a period during which the trapping electric field is generated, in-phase alternating trapping voltages are overlaid on the multiple electrode parts, or DC trapping voltages are overlaid on the multiple electrode parts, so as to form a substantially quadratic trapping electric field in the ion ejection direction. An alternating voltage signal whose amplitude is less than or equal to a maximum absolute value of the trapping voltage is overlaid on a first electrode part, which is closest to the ion ejection outlet, among the multiple electrode parts, for resonant excitation and selection of an ion motion range; and no voltage signal having the same phase as the alternating voltage signal is applied on a second electrode part of the multiple electrode parts except the first electrode part.

Further, in the ion trap analyzer according to the present invention, the alternating trapping voltage is overlaid on the first electrode part, and a trapping voltage having the same phase as the alternating trapping voltage is overlaid on the second electrode part.

Further, in the ion trap analyzer according to the present invention, in the multiple electrode parts in the ion ejection direction, an alternating voltage signal that is inverted to said alternating voltage signal is overlaid on at least one electrode of the second electrode part.

Further, the ion trap analyzer according to the present invention further includes a power supply, where the power supply applies, on another confining electrode which is in a direction substantially opposite the first electrode part and is located on a side different from the ion ejection outlet, an alternating voltage signal that is inverted to said alternating voltage signal, so as to generate a dipole alternating excitation electric field in a positive direction and a negative direction of the ion ejection outlet.

Further, the ion trap analyzer according to the present invention further includes a power supply, where the power supply applies, on another confining electrode which is in a direction substantially opposite the first electrode part and is located on a side different from the ion ejection outlet, an alternating voltage signal having the same phase as said alternating voltage signal, so as to generate a quadrupole alternating excitation electric field in a positive direction and a negative direction of the ion ejection outlet.

Further, the ion trap analyzer according to the present invention is a linear ion trap of which the trapping electric field is a two-dimensional quadrupole trapping electric field.

Further, in the ion trap analyzer according to the present invention, the ion ejection outlet includes an ejection slot perpendicular to an axial direction of the two-dimensional quadrupole trapping electric field.

Further, in the ion trap analyzer according to the present invention, the ion ejection outlet includes an ion ejection outlet on at least one side of an axial direction of the two-dimensional quadrupole trapping electric field.

Further, the ion trap analyzer according to the present invention is a static ion trap of which the trapping electric field is a one-dimensional quadratic trapping electric field.

Further, the ion trap analyzer according to the present invention is a three-dimensional ion trap of which the trapping electric field is a rotating quadrupole electric field.

Further, the ion trap analyzer according to the present invention includes a common power supply unit, where the common power supply unit applies a common voltage signal on the first electrode part and the second electrode part in the ion ejection direction.

Further, in the ion trap analyzer according to the present invention, the common power supply unit further includes a voltage attenuator that attenuates the common voltage signal applied on the second electrode part relative to a DC reference potential.

Further, in the ion trap analyzer according to the present invention, the trapping voltage is a digital voltage of 1 Hz to 100 MHz.

Further, in the ion trap analyzer according to the present invention, the alternating voltage signal is a combined voltage signal of non-single-frequency discrete voltage signals or voltage signals of continuous frequencies.

Further, the ion trap analyzer according to the present invention further includes a field adjustment electrode inserted in the ion ejection outlet, where the field adjustment electrode is located in the ion ejection direction, and does not fall within the boundary of the trapping space; in the multiple electrode parts, the alternating voltage signal is only applied on the field adjustment electrode.

An ion trap mass spectrometry analysis method according to the present invention includes the following steps: a step of trapping ions, in which ions generated in the ion trap or ions injected from outside the ion trap are trapped in the ion trap; a step of maintaining or adjusting an electric field in the ion trap, in which the electric field in the ion trap is maintained as or adjusted to be a substantially quadratic trapping electric field in an ion ejection direction; a step of applying an alternating voltage signal, in which an alternating voltage signal is applied on a first electrode part closest to an ion ejection outlet, for resonant excitation and selection of an ion motion range, an alternating excitation electric field is generated in a direction of the ion ejection outlet, and no alternating voltage signal having the same phase as said alternating voltage signal is applied on a second electrode part other than the electrode part closest to the ion ejection outlet; a step of adjusting an ion motion frequency, in which an intensity of the trapping electric field or intensities or frequencies of the trapping electric field and the alternating excitation electric field are scanned, and overall motion frequencies of the trapped ions in the direction of the ion ejection outlet, that is, secular motion frequencies of the ions, are changed, so that the secular motion frequencies sequentially coincide with the frequency of the alternating excitation electric field in the direction of the ion ejection outlet according to values of mass-to-charge ratios, so as to obtain a mass spectrum signal.

Further, in the ion trap mass spectrometry analysis method according to the present invention, an alternating voltage signal that is inverted to said alternating voltage signal is applied on at least one electrode of the second electrode part.

Furthermore, an ion fragmentation method according to the present invention includes the following steps: a step of trapping ions, in which ions generated in the ion trap or ions injected from outside the ion trap are trapped in the ion trap; a step of maintaining or adjusting an electric field in the ion trap, in which the electric field in the ion trap is maintained as or adjusted to be a substantially quadratic trapping electric field in an ion ejection direction; a step of applying an alternating voltage signal, in which an alternating voltage signal is applied on a first electrode part closest to an ion ejection outlet, for resonant excitation and selection of an ion motion range, an alternating excitation electric field is generated in a direction of the ion ejection outlet, and an alternating voltage signal having a phase different from that of said alternating voltage signal and an amplitude greater than that of said alternating voltage signal is applied on a second electrode part other than the electrode part closest to the ion ejection outlet; a step of dissociation, in which intensities and frequencies of the trapping electric field and the alternating excitation electric field are controlled, so that in the direction of the ion ejection outlet, a frequency of a motion component of ions in a certain mass-to-charge ratio range coincides with at least one of multiple frequencies of the alternating excitation electric field, and the ions collide with gas molecules introduced into the ion trap for dissociation.

According to the present invention, the orientation of the alternating electric field for resonant excitation can be enhanced by limiting an applying range of the in-phase alternating voltage.

Herein, generally, an alternating voltage signal used for resonant excitation of the ion motion range and with an amplitude less than or equal to 10% of a maximum absolute value of the trapping voltage is applied on an electrode part closest to the ejection outlet.

Herein, if connected at a position, which is outside the trap and does not block ion ejection, by using a bulk conductive structure, electrodes at two sides of the ejection outlet electrode are actually one electrode.

According to the present invention, an alternating voltage signal that is inverted to the alternating voltage signal that is used for resonant excitation and overlaid on the ejection outlet electrode part is applied on at least one other electrode part of the confining electrode group, so as to further enhance the orientation of an alternating electric field which is used for resonant excitation and induced by the alternating voltage signal.

In the present invention, the range of the "confining electrodes in the direction of the ejection outlet" are at least a part of physical electrodes that face the ion ejection direction, fall in a range with the ion trapping area in the trap as a center and having plus or minus 30 degrees at two sides of a ray towards the ejection outlet, and are applied with a trapping voltage including the ground potential; the "ejection outlet electrode part" refers to a discrete electrode part, which is closest to the center of the ejection outlet, among parts of the "confining electrodes in the direction of the ejection outlet"; "other electrodes" except the part at the ejection outlet refer to other electrode parts of the "confining electrodes in the direction of the ejection outlet" except the "ejection outlet electrode part"; the "opposite direction" refers to a direction of a reverse extension line that passes through the approximate geometric center or central axis of the ion trap apparatus relative to the involved particular entity; and the "substantially opposite direction" refers to an angle range having a deviation less than 10 degrees relative to the "opposite direction".

According to the present invention, the ion trap analyzer can be driven by using a digital ion trap mode; the trapping voltage may be a digital voltage of which the frequency is between 1 Hz and 100 MHz, so as to obtain a wide mass-to-charge ratio working range for trapping ions.

According to the present invention, the alternating excitation voltage applied near the ejection outlet electrode area may be a non-single-frequency discrete-frequency or continuous-frequency combined signal, which is used to simultaneously excite or eject multiple ions having different mass-to-charge ratios, or excite or eject all ions in a mass-to-charge ratio range. Based on this, some ions with a particular mass-to-charge ratio in this range may be reserved, while other ions are ejected.

Further, the technical solution of the present invention can be further combined with the prior art of adjusting a trapping electric field described in the background; for example, at least one part of the confining electrodes in the direction of the ejection outlet are divided into multiple parts in at least one direction perpendicular to the ejection direction. DC and RF trapping voltages having different amplitudes may be applied between these parts, so as to trap ions at multiple levels and implement a more complex ion analysis process.

Further, the solution of the present invention includes a special design, which includes a field adjustment electrode serving as a part of the confining electrode structure, located on a straight line of the ion ejection direction of the ion trap, and located at the ejection outlet of the ion trap, where the alternating excitation voltage is only applied on the field adjustment electrode part, and is not applied on other confining electrode structures. Such a design may simplify a drive circuit of the confining electrode system part.

According to the present invention, when targets ions to be analyzed are fragmented in the resonant excitation process, it becomes not easy for the target ions to flow out of the ion trap, and instead the target ions are maintained at s large vibration amplitude at all times.

In the ion fragmentation method according to the present invention, the key to success is to apply, on electrode parts other than an ejection outlet confining electrode part, an auxiliary excitation voltage having a greater amplitude and a phase different from that of an excitation voltage applied on the ejection outlet confining electrode part, to replace the original ejection outlet excitation voltage to serve as a main excitation voltage signal to excite ions. Therefore, in the motion mode of the target ion group, there are less ions moving along the plane where the ejection outlet is located or moving near the axis, and therefore, the loss caused by ions escaping from the ejection outlet is reduced, and the overall efficiency of the dissociation process is improved.

BRIEF DESCRIPTION OF THE DRAWINGS

The following describes an overall structure of features of the present invention with reference to the accompanying drawings. The provided drawings and related description are used to illustrate the embodiments of the present invention, but are not intended to the limit the present invention.

The following describes the implementation manners of the present invention in detail with reference to the accompanying drawings, where identical parts are marked with identical signs, and repeated descriptions are omitted.

DETAILED DESCRIPTION

Before the present invention is further illustrated, the prior art relating to the present invention, that is, segmenting a confining electrode into multiple electrodes and allocating different trapping voltages to the multiple electrodes to form an ion trap, is described briefly.

Figure 1A:
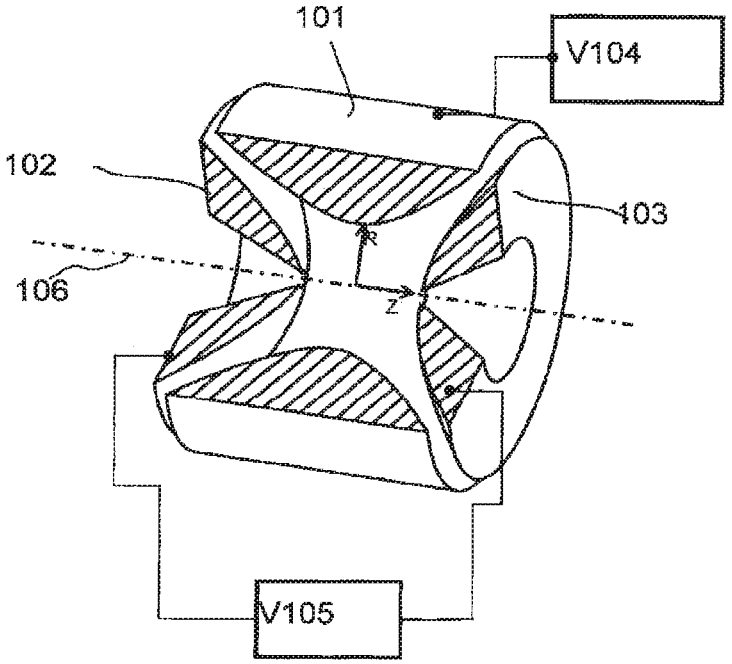
FIG. 1a PRIOR ART
FIG. 1*a* is a structural diagram of a principle for implementing a common resonant excitation mode in a three-dimensional ion trap in the prior art.
Figure 1B:
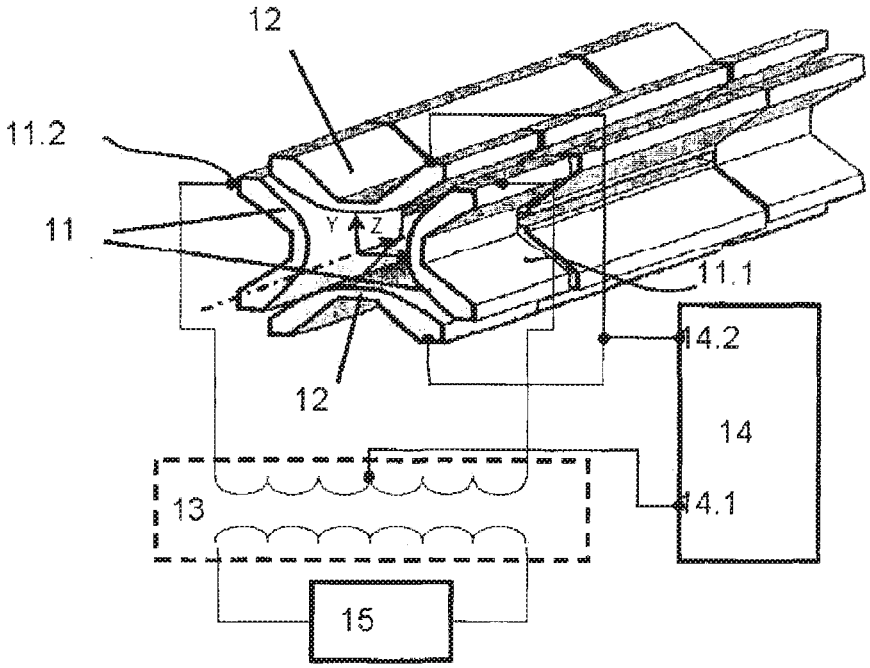
FIG. 1b PRIOR ART
FIG. 1*b* is a structural diagram of a principle for implementing a common resonant excitation mode in a two-dimensional linear ion trap in the prior art.

In the prior art, a trapping space of an ion trap is generally described as a space enclosed by a set of confining electrodes, and these electrodes may be rotating symmetric ring electrodes 101 and end cap electrodes 102 and 103 shown in FIG. 1*a*, and may also be several axially extended cylindrical-surface electrode pairs such as 11 and 12 shown in FIG. 1*b*. In the three-dimensional ion trap shown in FIG. 1*a*, the central axis thereof is a rotation axis 106 of these rotating symmetric electrodes; in the two-dimensional linear ion trap shown in FIG. 1*b*, the "cylindrical surface" is a curved surface formed by a line that is parallel to a central axis fixed line (which is defined as the Z axis) in the ion optical structure and moves along a directrix. As long as an electrode structure achieves that an electric field meeting a trapping condition for ions having a certain mass-to-charge ratio can be formed within a certain period in an electrode system having the above structure, the electrode structure is one of the ion trap electrode geometric structures discussed in the present invention.

Figure 2A:
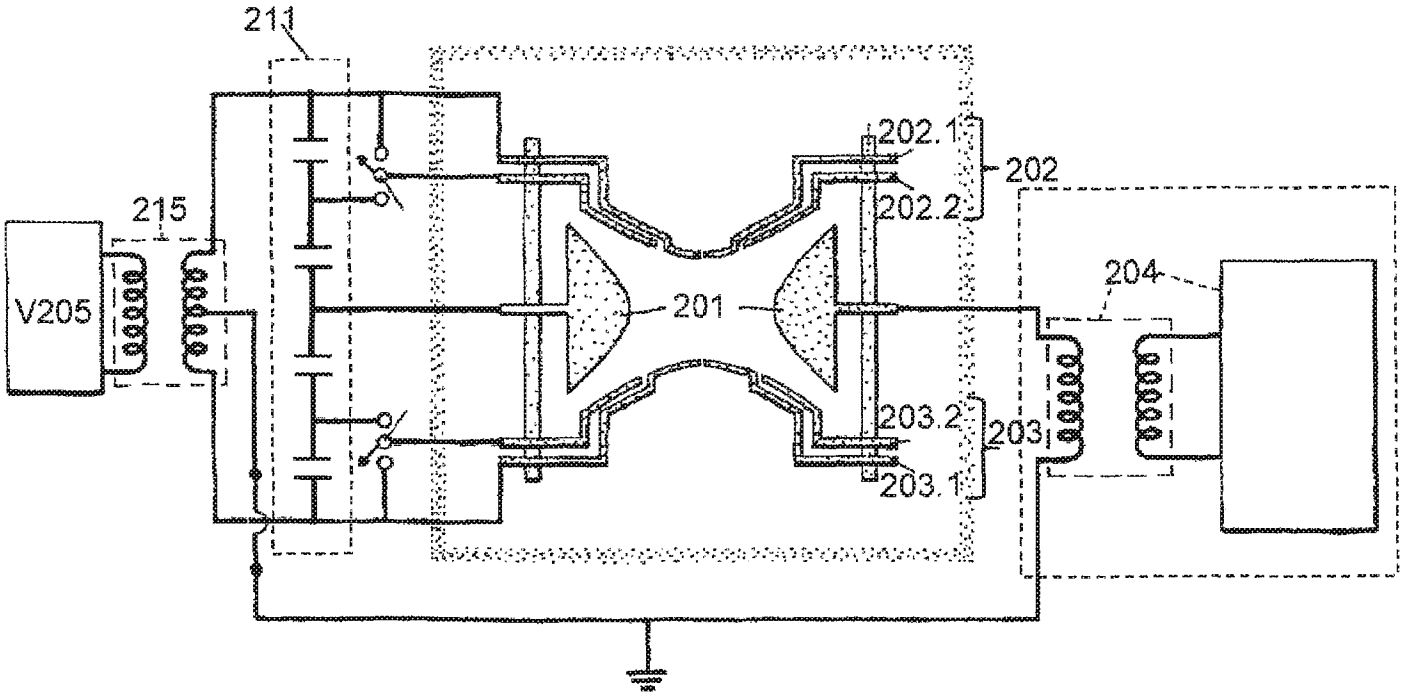
FIG. 2a PRIOR ART
FIG. 2*a* is a structural diagram of a method of segmenting a confining electrode into multiple electrodes and allocating different trapping voltages thereto in a multi-ring three-dimensional quadrupole ion trap in the prior art.
Figure 2B:
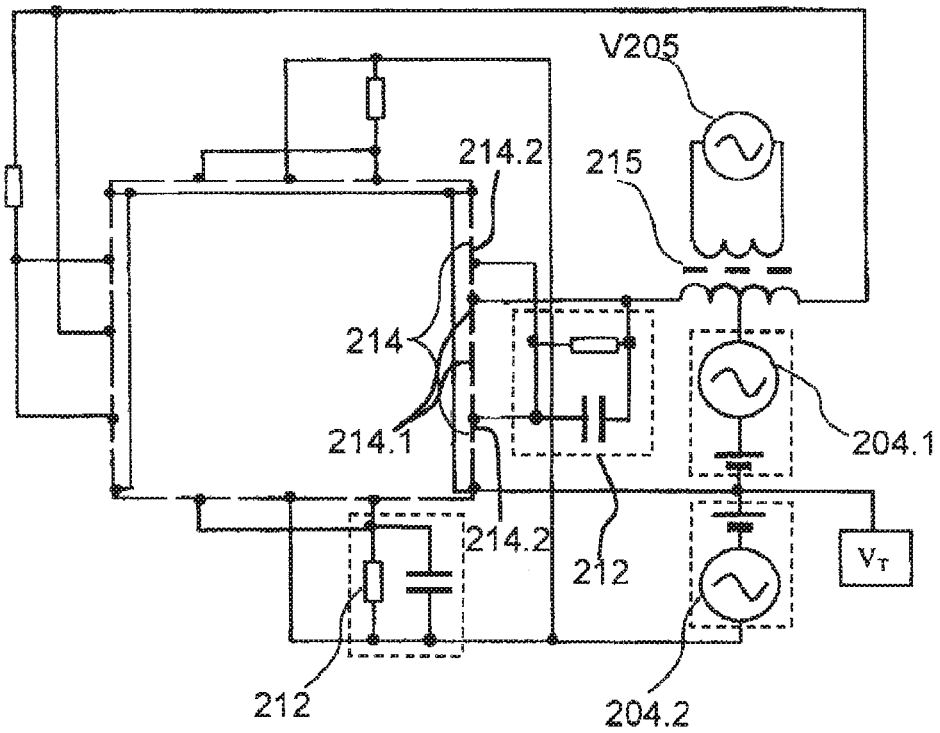
FIG. 2b PRIOR ART
FIG. 2*b* is a structural diagram of a method of segmenting a confining electrode into multiple electrodes and allocating different trapping voltages thereto in a two-dimensional linear ion trap based on a printed circuit board in the prior art.
Figure 2C:
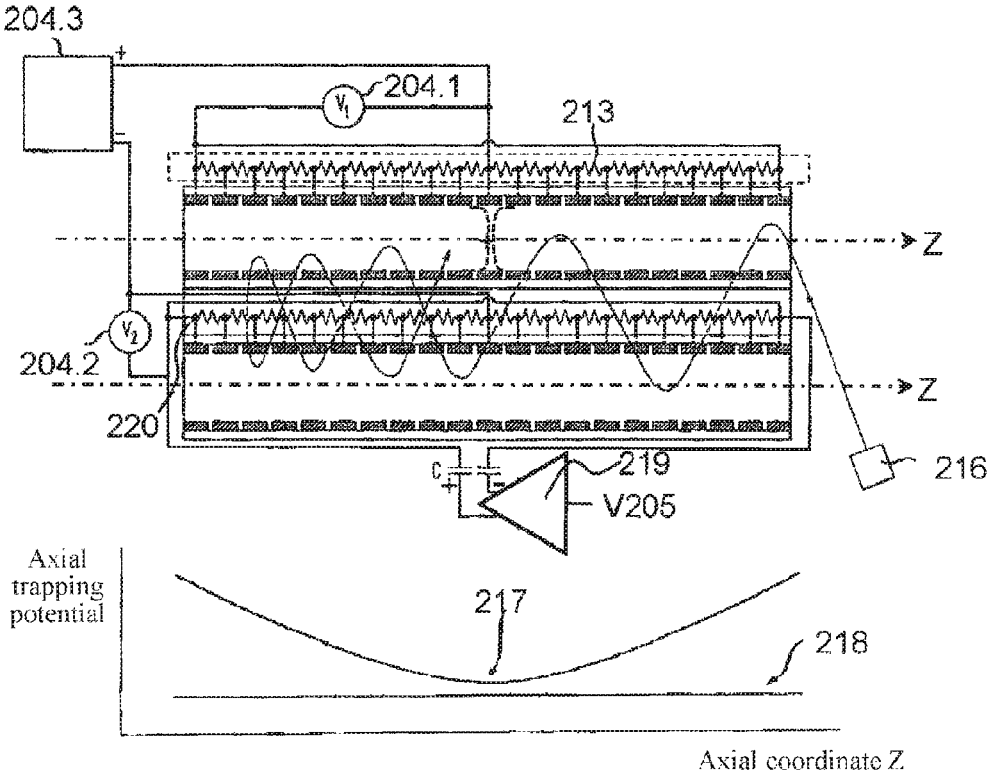
FIG. 2c PRIOR ART
FIG. 2*c* is a structural diagram of a method of segmenting a confining electrode into multiple electrodes and allocating different trapping voltages thereto in a substantial quadratic electric field static ion trap in the prior art.

When an ion trap is merely used as an ion storage apparatus, ions can be stored by applying various forms of trapping voltages, including a DC trapping voltage and an AC trapping voltage, on the at least a part of confining electrodes. The trapping voltage applied on the ion trap in this case is generally a DC potential or a single-frequency AC voltage, and it is unnecessary to further overlay an alternating voltage of another frequency on the ion trap to trap ions. However, when the ion trap works as a mass analyzer, ions generally need to be sequentially extracted from the trapping electrode structure according to their mass-to-charge ratios, so that a mass spectrum can be obtained. Therefore, it is necessary to open several ejection outlets on the originally complete surface of the trapping electrode. It has been pointed out in previous inventions that a complete confining electrode structure may be replaced by a combination of multiple discrete electrode structures, for example, the multi-ring three-dimensional quadrupole ion trap structure shown in FIG. 2*a*, and the two-dimensional linear ion trap structure based on a flat printed circuit shown in FIG. 2*b*. These ion trapping structures are not limited to RF storage devices. For example, FIG. 2*c* shows how to implement a static ion trap structure that includes a quadratic static potential trap along the Z axis by using a voltage-dividing resistor network 213. Different trapping solutions can be used to introduce ions into these ion trap apparatuses, and it is not limited to storing ions by using a quadrupole field. However, when these apparatuses are used as mass analyzers, it is necessary to apply an excitation voltage or a screening voltage on at least a part of confining electrodes of the ion trap to change the motion range of the ions within at least one period during the ion trapping process, so that the trapped ions present different trapping stability in this period according to their mass-to-charge ratios. Especially, in a resonant excitation mode, generally a static potential field or pseudo potential field that stores the electric field should present a basically quadratic field distribution in a certain ejection direction, that is, in an ejection direction such as the direction X, the potential basically satisfies the quadratic field distribution $V(x)=Ax^2+o(x^n)$, where $o(x^n)$ is a residual high-order field component, and its proportion is generally less than 20% of the total field potential contribution; an alternating excitation voltage of which the frequency is the same as, an integral multiple of, or a fractional frequency of the motion frequency of ions with a selected mass-to-charge ratio, and an electric field induced by the alternating excitation voltage are overlaid in this direction to excite the ions. Otherwise, during the resonant excitation process, a vibration potential trap of the ions significantly deviates from the simple harmonic potential trap, and fails to satisfy an amplitude-frequency resonance condition, which results in an ejection delay of ions with the same mass-to-charge ratio, thereby affecting the mass resolution of the mode. According to different objectives of these working periods, the working periods having a mass spectrometry function are generally referred to as a resonance scanning and ejection phase, a mass selection and isolation phase, or an ion excitation and dissociation phase. Generally the excitation voltage should not change the trapping feature of ions by a great degree, so the amplitude of the excitation voltage is generally low. In general cases, an absolute value of a voltage amplitude extreme value of an alternating voltage which is overlaid on the confining electrode of the ion trap and used as a resonant excitation signal should be less than 10% of the absolute value of the extreme value of the trapping voltage applied on the trap.

In the prior art, no matter it is a single electrode or a combined electrode structure, an alternating voltage required by resonant excitation is applied in the same form on all parts of a confining electrode group which is on the same side with the ion ejection direction and is applied with alternating trapping voltages or DC trapping voltages having the same frequency and same phase. For example, in the prior art shown in FIG. 2*a*, a trapping voltage source 204 required by each discrete electrode is applied on each discrete confining electrode group, such as end cap electrode groups 202 and 203 shown in FIG. 2*a*, through an RF capacitor network 211. In this case, an excitation voltage 205 is divided into a positive phase and a negative phase by a coupling transformer 215 and transmitted by the same voltage-dividing network 211, and therefore, the excitation voltage 205 is inevitably coupled, in an in-phase manner, to a confining electrode part near an ejection outlet, such as (202.1, 203.1), and other parts of the confining electrode group in this direction, such as (202.2, 203.2). In the case of a linear ion trap, as shown in FIG. 2*b*, by using a confining electrode group 214 in an ion ejection direction as an example, a pair of inverted trapping RF sources 204.1 and 204.2 are applied on each part of the confining electrodes, such as 214.1 and 214.2, through a resistor-capacitor network 212, and similarly, an excitation voltage 205 passes through a transformer 215 and is transmitted by the same voltage-dividing network 212; therefore, the excitation voltage 205 is inevitably coupled, in an in-phase manner, to a confining electrode part near the ejection outlet, such as 214.1, and other parts of the confining electrode group in this direction, such as 214.2.

Similarly, in static ion trap with a quadratic axial field shown in FIG. 2*c*, the trapping voltage sources 204.1 and 204.2 are both assigned to each ring electrode through a voltage-dividing resistor network 213, and an inner cylinder bias potential and an outer cylinder bias potential of the ring are provided by a voltage source 204.3. When the potential distribution among ring electrode groups satisfies a quadric curve 217 shown in the drawing, ions injected by an external ion source 216 into the trap can be stored. The problem of kinetic energy consumption in initial ion injection can be solved by changing a basic bias potential curve 218 of the trap. When ions trapped in the trap need to resonate and be ejected, a bi-phase differential operational amplifying circuit 219 may be used to apply a group of amplifying alternating excitation signals with opposite phases of an excitation voltage 205 on the right and left sides of the ring electrode group array, so that ions are ejected from two ends of a dual-cylinder structure. These common voltages are finally connected to an alternating node such as 220 through a capacitor, and therefore, in-phase excitation voltages are applied on all ring electrode groups near the outlet at each side in the dual-cylinder electrode structure.

The apparatus and technical solution of the present invention are aimed at disassociating the assignment relationship of these trapping voltages from the assignment relationship of the excitation voltages for resonant excitation of ions, so as to achieve the purpose of improving the mass analysis performance of this type of ion traps.

First Embodiment

The present invention first describes how to implement a resonant excitation process of ion motion range by applying an alternating voltage on a confining electrode part at an ejection outlet by using a two-dimensional linear ion trap, and enhance the orientation of an alternating electric field, for resonant excitation, induced by the alternating voltage signal.

Figure 3:
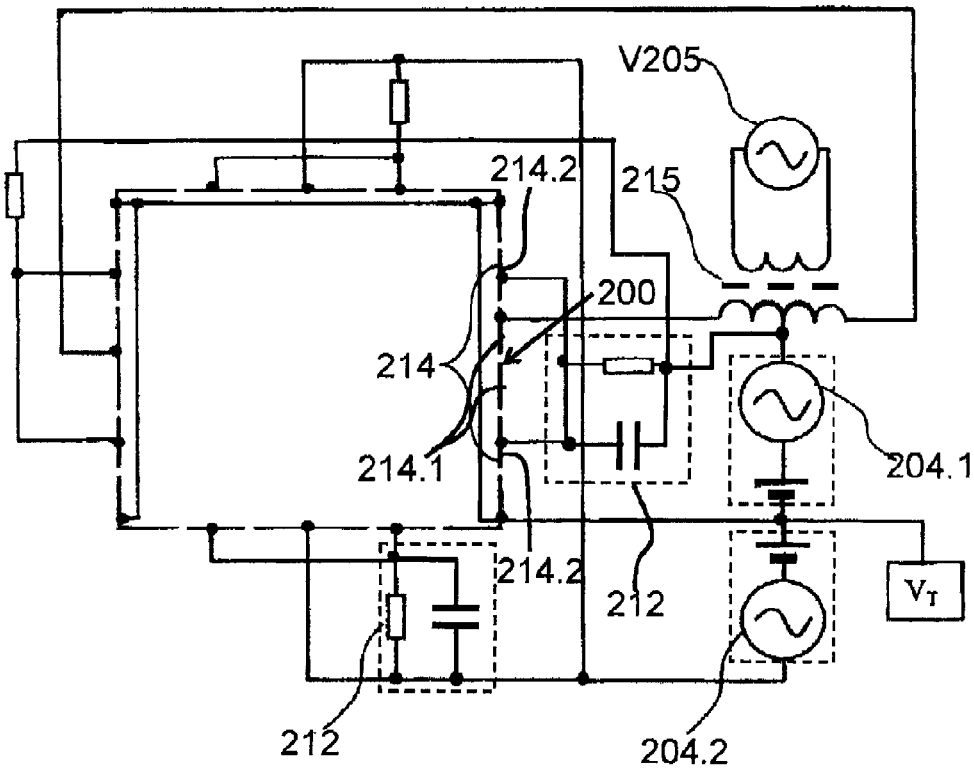
FIG. 3 is a circuit structural diagram of an ion trap that uses a method of only applying an AC excitation voltage on an electrode at an ejection outlet part according to an embodiment of the present invention.

The technical solution of the first embodiment of the present invention is shown in FIG. 3, which shows a drive circuit connection diagram on a cross section of a linear ion trap. Similar to the technical solution in the prior art, in this design solution, a confining electrode 214 at an ejection outlet 200 on the side of the ion trap is divided, along a direction perpendicular to an ion ejection direction, into a middle branch electrode 214.1 at the ion ejection outlet and electrodes 214.2 on two sides of the middle branch electrode 214.1. In-phase RF trapping voltages are applied on these confining electrodes by a same RF voltage source 204. However, different from the prior art shown in FIG. 2*a*, in this solution, when a trapping voltage, on which an alternating excitation voltage is applied, produced by an alternating excitation voltage source 205 and a coupling transformer 215 is applied on the confining electrode group 214, the excitation voltage signal is only applied on the middle branch electrode 214.1. The trapping voltage signal on the electrode group 214.2 is provided by an RF voltage source 204.1, which is in front of the coupling transformer 215, through a band-pass capacitor-resistor coupling circuit 212, and does not include the alternating excitation voltage signal from the excitation voltage source 205.

In this manner, when ions move near the ejection outlet 200 during the resonant excitation, the motion coupling between the ejection direction and the non-ejection direction of the trapped ions caused by the high-order field effect induced by the deficiency of the trapping electric field herein is not enhanced, which is unlike the prior art where the motion coupling is gradually enhanced along with the vibration amplitude as an alternating excitation signal for resonant excitation is applied on the two side electrodes 214.2. Therefore, an ion motion trend of gradually deviating from a plane of the main ejection direction caused by the ion motion coupling effect can be effectively reduced as compared with the prior art, so that more analyzed ions can be smoothly extracted out of the ion trap mass analyzer via the ejection outlet 200 and detected, thereby improving the test limiting performance of a mass spectrometry instrument.

Figure 4:
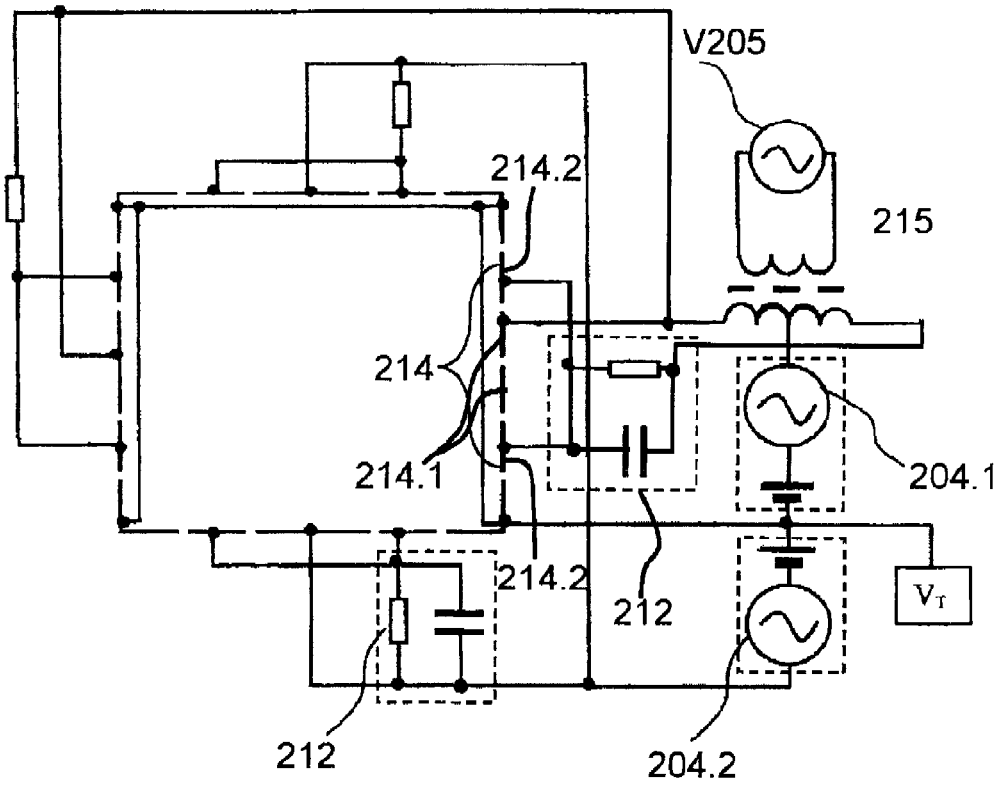
FIG. 4 is a circuit structural diagram of an ion trap that uses a method of applying an AC excitation voltage on an electrode part at an ejection outlet, and applying voltage signals that are inverted to said AC excitation signal on other electrodes, on which in-phase alternating trapping voltages are applied in the direction, in the trapping electrode group.

As an improvement to this technical solution, as shown in FIG. 4, instead of applying, on the two side trapping electrodes 214.2, a signal that is output by the direct trapping RF voltage source 204.1 and does not include an alternating excitation voltage signal from the excitation voltage source 205, a trapping voltage signal which is output from an inversion end of the coupling transformer 215 for the excitation voltage and applied with an inverted alternating voltage directly output by the alternating voltage source 205 is applied on the side trapping electrodes 214.2. Therefore, an ion motion trend of gradually deviating from a plane of the main ejection direction caused by the motion coupling between the ejection direction and non-ejection direction is further reduced due to the resonant excitation of the inverted alternating excitation signal applied on the two side electrodes 214.2, where the motion coupling is caused by the high-order field effect induced by the trapping electric field deficiency at the ejection outlet. Therefore, the orientation capability of the alternating electric field finally excited by the excitation voltage source 205 in the trap is further enhanced, which further improves the testing performance of the mass spectrometry instrument.

It should be noted herein that, although the structure of the middle branch electrode 214.1 closest to the ion ejection outlet is formed by two discrete electrode structures on two sides of the ion ejection outlet in the schematic diagram, in actual manufacturing, two side electrode bodies of the ejection outlet electrode are usually connected by using a bulk conductive structure at two ends or at positions that do not block ion ejection, for example, outside the trap, and actually they are a complete electrode. Similarly, this method also applies to side electrodes 214.2 on the two sides, and the side electrodes 214.2 can be implemented in the form of complete electrodes.

Moreover, the means of improving the orientation of the alternating excitation electric field by limiting the applying range of the excitation voltage in the ion trap used in the technical solution can also be used to improve the resolution capability of the ion trap mass analyzer. FIG. 5(*a*) to FIG. 5(*c*) show a comparison of linear ion trap resolution performance between the dipole excitation solution used in the prior art and two excitation solutions shown in FIG. 3 and FIG. 4. In this example, to make the mass analyzer an ion flow mass selector capable of ejection in two perpendicular directions X and Y (please show X and Y in the drawing) under the same condition, single-direction distance stretch, which is usually to improve the mass resolution, is not performed on the electrode pair; with the symmetric design, the high-order field expansion $\Sigma A_n Re(x+yi)^n$ of the internal electric potential of the ion trap, the quadrupole field component A2 is 98%, and the weights of other multi-pole (less than 28 poles) field components are all less than 0.5%. The field radius of the ion trap is 5 mm; under a high working air pressure $9\times10^{-2}$ Pa, when a conventional excitation voltage configuration solution shown at the left of FIG. 5 is used, due to the effect of the extremely high-order negative multi-pole field component (where n>14) at the ejection outlet, the motion range of ions decreases again because of the resonance detuning when the ions move to this position. As a result, ejection of some ions is delayed, which causes loss of the resolution at the peak of the mass spectrum and a trailing phenomenon. As shown in the drawing, ions whose mass number is 503Th and ions whose mass number is 502Th cannot be completely separated at the bottom, and therefore, when selecting an ion chromatography for quantification of ions 503Th, ions 502Th, as a false signal, may interfere with the quantification of ions 503Th, resulting in a deviation of the result.

Figures 5A, 5B, 5C:
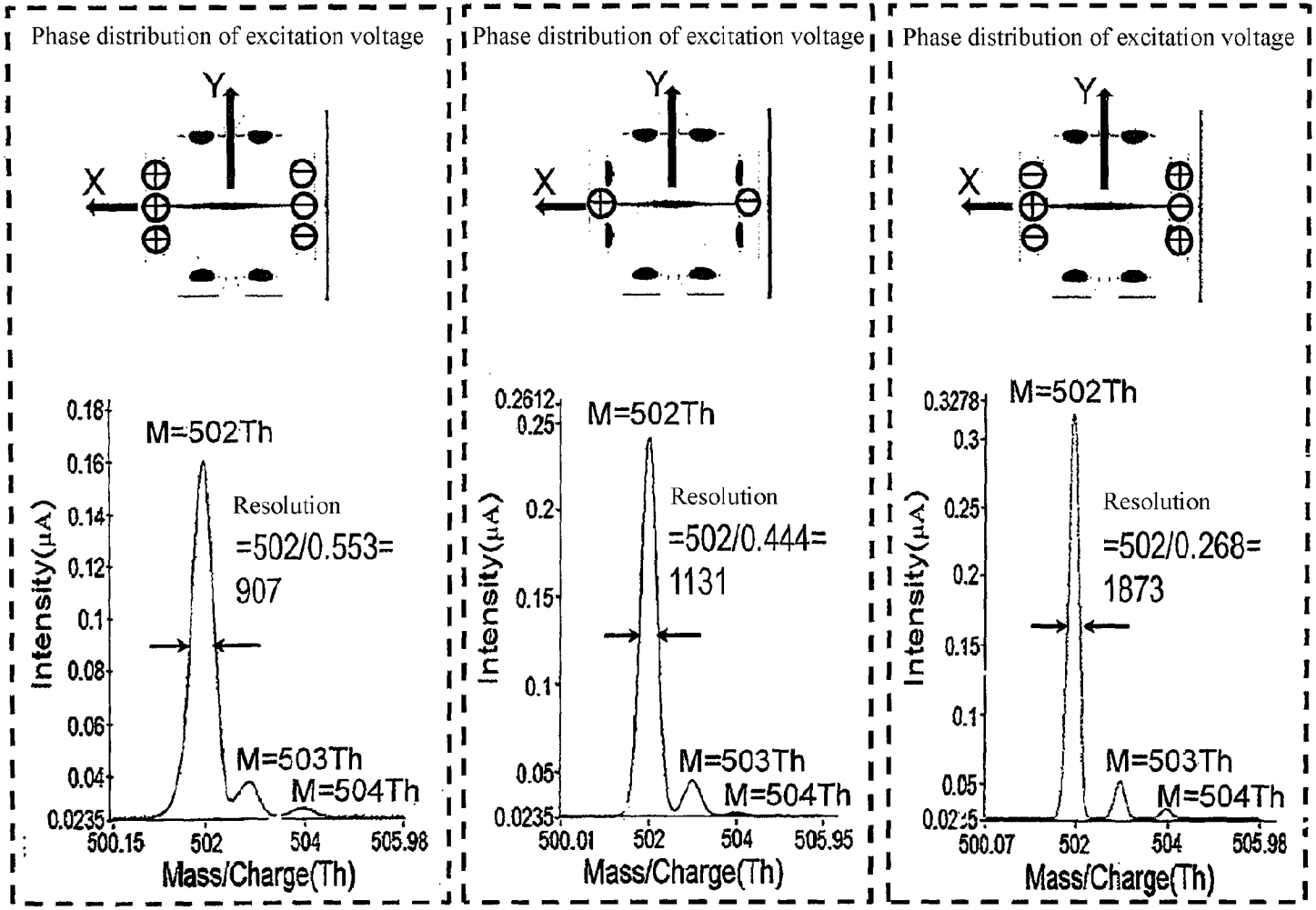
FIGS. 5*a*-5*c*show an ion ejection difference and a mass resolution difference between the conventional excitation voltage applying method in the prior art and the methods of applying an excitation voltage on a part of electrodes shown in FIG. 3 and FIG. 4 in an embodiment of the present invention.

As shown in FIG. 5*b*, after this technical solution is used, an in-phase excitation voltage is only applied on the central electrode, which enhances the orientation. When ions move to the ejection outlet, because the in-phase excitation voltage is applied on the confining electrode closer to the ejection outlet, the intensity of the excitation electric field sensed by the ions is enhanced rapidly compared with the intensity at the center of the trap. Therefore, the delayed ejection, which would originally occur in this area due to the resonance detuning, is prevented because the ions are forcedly ejected as the excitation voltage is enhanced in a partial area, and the mass resolution is therefore improved. As shown in FIG. 5*c*, an inverted excitation voltage is further applied on side electrodes, and in this case, the intensity of the excitation electric field is enhanced in a partial area by a greater degree, so that delayed ejection caused by resonance detuning can be prevented for more ions, thereby significantly improving the resolution. The feature of achieving basic bottom separation of ions with a smaller mass number difference under the same trapping voltage condition can be represented by the resolution M/ΔM. According to the improvement to the resolution, by means of this technical solution, hopefully a shielding capability of the ion trap mass spectrometer against chemical noise can be improved.

It can also be noted in FIG. 5*c* that, to improve the symmetry and integrity of the excitation electric field, we not only use a method of limiting the applying range of the excitation voltage mentioned in the present invention in the direction of the ejection outlet of the ion trap, but also apply an alternating excitation voltage inverted to the voltage of the electrode part at the ejection outlet, so that in the ion trap, the excitation electric field induced by the alternating voltage becomes a complete dipole excitation electric field. Therefore, ions that substantially perform simple harmonic vibration at the center of the trap can also continuously sense a basic intensity of the excitation electric field and be ejected gradually in resonance, so that the ejected ions are better synchronized before entering the high-order area at the ejection outlet. Therefore, a more desirable mass resolution capability can be obtained.

It should be noted that, this method not only applies to the dipole excitation process, but also applies to a quadrupole excitation process. A method for generating a quadrupole excitation electric field in an ion trap to apply an in-phase alternating excitation voltage on a pair of opposite electrodes in the ejection direction; in this way, in a direction perpendicular to the ejection direction, an alternating excitation voltage component which is inverted to a transient voltage at the trap center is generated, and therefore a quadrupole excitation electric field is formed. Because the quadrupole excitation electric field is a quadratic field, the basic feature thereof is that ions with a greater distance to the center of the ion trap sense a stronger quadrupole excitation effect. Therefore, in the quadrupole excitation process, the ions can be forcedly ejected near the ejection outlet. This method can also limit the applying range of the in-phase quadrupole excitation voltage within the adjacency of the ejection outlet, so as to further enhance the excitation effect on ions with high vibration amplitude. Therefore, the resolution of mass-selective ion ejection by using quadrupole excitation is also improved.

Figure 6:
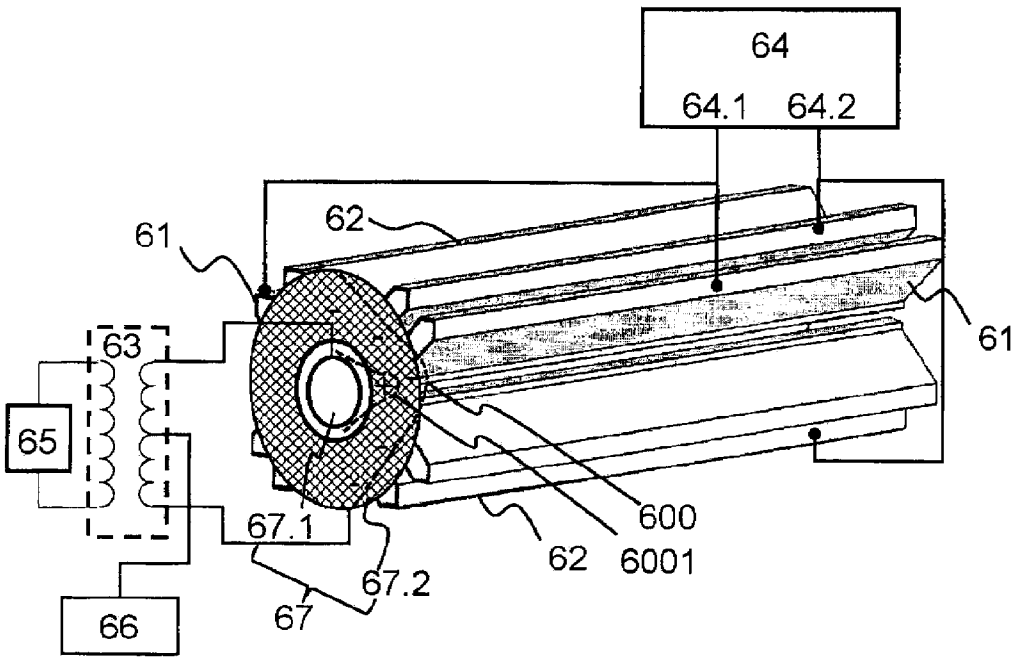
FIG. 6 is a circuit structure diagram of a mass analyzer apparatus that uses a method of applying excitation voltage signals of different phases on an axial confining electrode outlet part of and lateral electrodes of a linear ion trap according to an embodiment of the present invention.

In addition, it should be noted that, apart from the radial resonant excitation ion ejection mode in which ejection outlet is in the radial direction, the method for improving the orientation of the excitation electric field can also be used in other working modes of the linear ion trap; the axial mass-selective ejection shown in FIG. 6 is an example. Generally, in an axial selective ejection process, an RF power supply 64 applies inverted RF voltages 64.1and 64.2on confining electrode pairs 61 and 62 which are shaped like quadrupole rods in the radial direction of the ion trap, so that ions are trapped by a quadratic pseudo potential field in the radial direction in the trap. An alternating voltage signal is applied on the mesh end cap electrode 67. The deficiency of the rod-end electrode at the end cap causes ion motion coupling between the axial direction and the radial direction due to a cross high-order term between axial electric and radial electric fields in the fringing field, and a cone-like pseudo potential trap reflection surface is generated at the end surface; ions in the trap gradually increase due to resonance between the motion frequency and the excitation frequency applied on the end cap electrode, and are finally ejected from a position with a large radius at an equipotential surface of the pseudo potential in the radial direction.

However, due to the phase characteristic of the pseudo potential surface, in such an axial ion ejection manner, it cannot be ensured that ions are ejected from the center of the mesh end cap electrode in the process. In this case, as the ejected ions are not required to have high radial vibration amplitude, the ions ejected in this case may not be the most effectively selected ions for resonant excitation, and as a result, mass selectiveness of the ejected ions cannot be ensured. Moreover, for high-speed scanning, ions with close mass-to-charge ratios have similar radial amplitude when moving near the end cap at the same time, and may be ejected at the same time; as a result, the maximum scanning speed of the axial ejection manner is lower than that of the radial ejection manner.

In this method, after a pair of inverted drive signals are applied, through an alternating excitation power source 65 and a coupling transformer 63, on two parts that are separated in the radial direction, under the effect of an end cap DC trapping power source 66, a cone-shaped blocking DC potential trap surface 60 is first formed at the end cap; when ions do not resonate with the output frequency of the alternating excitation power source, they directly bounce at the potential trap surface 600 and cannot be ejected; when ions resonate with the output frequency of the alternating excitation power source, they may enter the potential trap surface 600 under the effect of the fringing field that excites the motion range, which is equivalent to that the ions sense a weak trapping potential trap, such as an area shown by sign "–", and finally the ions can be ejected from an external ring mesh electrode 67.2 in a mass-selective manner.

With regard to the possible random ejection process that may occur on ions with small radial vibration amplitude, with a drive manner using inverted excitation voltages at the center, two inverted excitation drive areas separated by a zero-excitation vibration surface 6001 appear in the DC potential trap area. When ions are forced to resonate near the central axis, the axial vibration amplitude thereof increases, and the ions enter an inverted alternating excitation area. In this way, the radial vibration amplitude of the ions is inhibited due to the effect of the inverted excitation electric field, and therefore the ions are not ejected. This is equivalent to an extra inhibiting potential, which is shown as an area marked with "+" in the drawing. The ions can be ejected from the ring mesh end cap electrode 67.2 nearby only having an in-phase excitation area only when the radial vibration amplitude thereof is large enough. In this manner, ejection of ions having similar mass-to-charge ratios along the axial direction is avoided, and the analysis performance of the linear ion trap is improved.

Second Embodiment

As described above, the two-dimensional linear ion trap structure is an exception of quadratic field ion traps, all other ion trap mass analysis apparatuses that have a quadratic field potential trap in some direction inside and subject ions to simple harmonic vibration at an approximately definite frequency in the trap can use the resonant excitation mode, and can use the manner of limiting an applying range of the in-phase alternating excitation voltage in this method to improve or limit the orientation of the alternating excitation electric field.

For example, in the static ion trap shown in FIG. 2*c*, a potential trap with a quadratic curve shown as the potential line 217 may be formed on the axis by the voltage-dividing resistor network 213. After ions produced by the source 216 and injected into the ion trap are trapped by the potential trap, an amplifier 219 that outputs a pair of bidirectional differential drive signals may apply an excitation voltage V205 to the electrode connection points 220 at two ends, so as to generate a dipole excitation electric field distributed along the axial direction in the trap.

Figure 7:
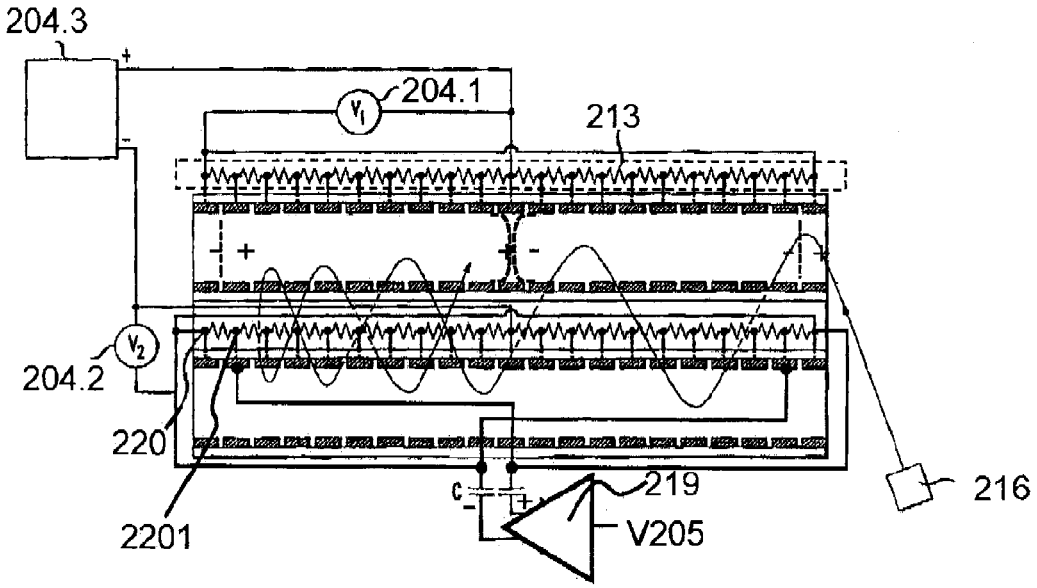
FIG. 7 is a circuit structure diagram of a mass analyzer apparatus that uses a method of applying excitation voltage signals of different phases on different parts of an electrode outlet in a substantial quadratic field static ion trap according to another embodiment of the present invention.

After the distribution area of the excitation voltage is limited by using the method of the present invention, as shown in FIG. 7, an in-phase voltage and an inverted voltage may be separately applied on the electrode connection points 220 at two ends and the electrode connection point 2201 relatively closer to the middle, so that in the cylindrical storage space in the trap, an inverted excitation electric field is formed at a part which is covered by the ring electrode and between the connection points 220 and 2201. In this manner, after the static ion trap measures a mirror current of ions, the ions return to the central part and are excited again by the excitation voltage V205 to obtain large vibration amplitude, so that the mirror current of the ions can be detected again. Due to the inverted excitation area at the end part, according to a principle similar to the axial excitation principle described in the foregoing embodiment, the stored ions can be prevented from excitation and ejection.

Therefore, the mirror current of ions can be measured repeatedly to reduce the loss of each ion analysis process. Usually, in this process, the excitation voltage V205 used may be an alternating excitation signal having a continuous broadband, so that for all ions in a wide mass range, their corresponding resonant excitation frequencies can be found, and their vibration amplitude can be expanded.

Third Embodiment

Figure 8:
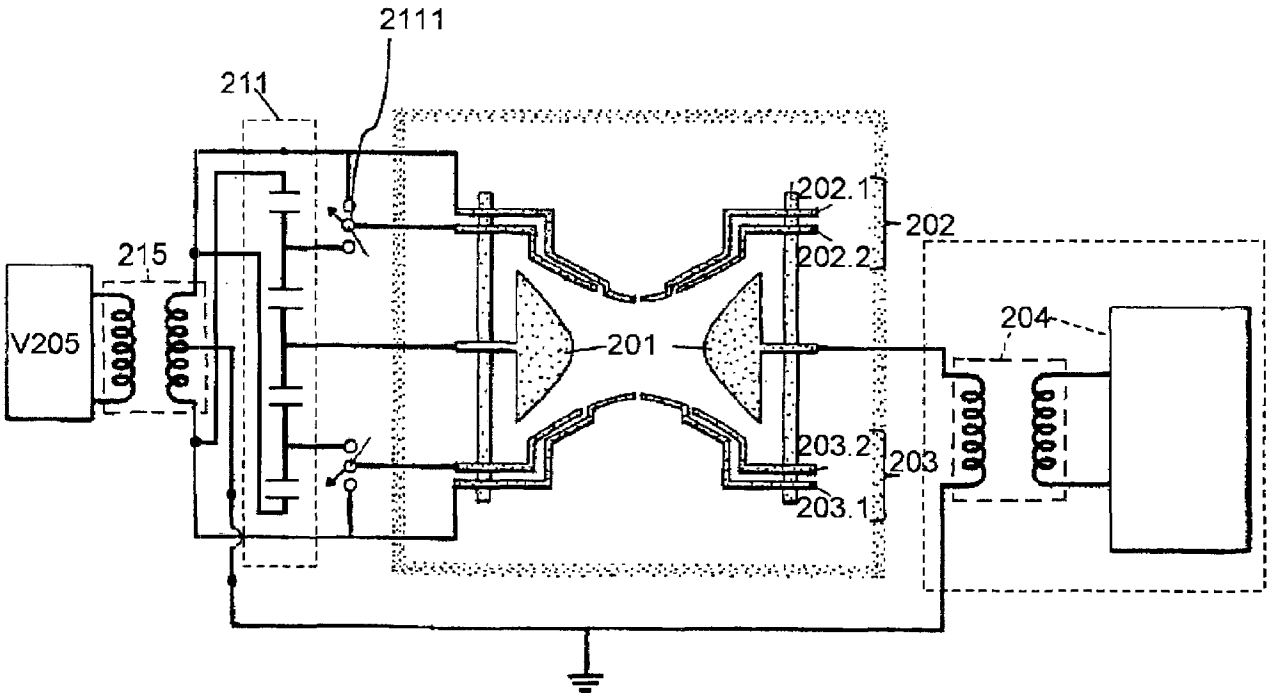
FIG. 8 shows a mass analyzer apparatus that uses a method of applying excitation voltage signals of different phases on different parts of end cap electrodes in a rotating three-dimensional RF ion trap, and a circuit structure example of an adjustment method of setting a trapping voltage and an excitation voltage on each part of confining electrodes in a direction of an ejection outlet by using a common power supply and a voltage attenuator relative to an AC ground potential according to another embodiment of the present invention.

The above method for improving or limiting the orientation of the alternating excitation electric field by limiting an applying range of the in-phase alternating excitation voltage also applies to a conventional three-dimensional ion trap. As shown in FIG. 8, a switch 2111 may switch an applied excitation voltage, which is applied on ring auxiliary electrodes 202.2 and 203.2 other than electrodes 202.1 and 203.1 at the ejection outlet of the ion trap, between an option of outputting a voltage having the same phase as an excitation voltage 205 that serves as a source and an option of outputting a voltage inverted with the excitation voltage 205. In this solution, for the working manner of outputting an inverted excitation voltage, an RF voltage attenuator formed by a capacitor voltage-dividing network 211 may further be used to attenuate the excitation voltage V205 applied on the ring auxiliary electrodes 202.2 and 203.2 relative to an AC ground potential; in this way, by applying different attenuation voltage ratios in two directions of the end cap voltage, when an inverted excitation mode is used for high-efficiency mass-selective ion ejection, ions are ejected from a certain end cap, such as 202, by introducing an asymmetric hexapole RF field component in a main RF trapping electric field, and therefore, less detectors are needed, and the structure of the whole mass spectrometer is simplified.

Apart from the mass-selective resonant ejection process, in a complete tandem spectrometry analysis manner, ion vibration amplitude further needs to be selected in the mass range by means of resonant excitation, and the selected ions need to collide with ambient neutral gas in the trap for dissociation. In this process, we do not want the ions to leave the ion trap via the ejection outlet. Therefore, in multiple processes of a mass spectrometry analysis method, we can use the inverted excitation manner and the conventional resonant excitation manner alternatively in different processes. For the ion storage, cooling, and excitation dissociation processes, we may choose not to attenuate the trapping voltage so that the electric field at the center of the ion trap is closer to an ideal quadrupole field, and not to use the inverted excitation manner to improve the orientation of the ejection excitation electric field, so that a parent ion and a possible child ion thereof do not escape via the ejection outlet easily, thereby reducing the loss of ions. In the resonant mass-selective ion excitation ejection process, the trapping voltage may be attenuated, so as to introduce a field component with multiple poles, such as a hexapole field component $A_3$ and an octupole field component $A_1$, to the electric field at the center of the ion trap; and the orientation of the ejection excitation electric field is improved by using the inverted excitation manner, so that ions with mass-to-charge ratio to be measured escape via the ejection outlet quickly and efficiently, thereby improving the ion detection rate and the mass resolution capability of the obtained mass spectrum.

Fourth Embodiment

The foregoing method of limiting the area of the excitation voltage not only applies to an ion trap apparatus having only one storage area, but also applies to an ion trap mass analysis apparatus having multiple ion storage areas. Herein, for ease of description, we use a special apparatus having a central ion storage area and an external ion storage area as an example for description. A common feature of these technical solutions is that at least a part of confining electrodes in the direction of the ejection outlet is divided, in at least one direction perpendicular to the ejection direction, into multiple parts. DC and RF trapping voltages of different amplitudes may be applied between these parts, so as to trap ions at multiple levels and implement a more complex ion analysis process.

Figure 9B:
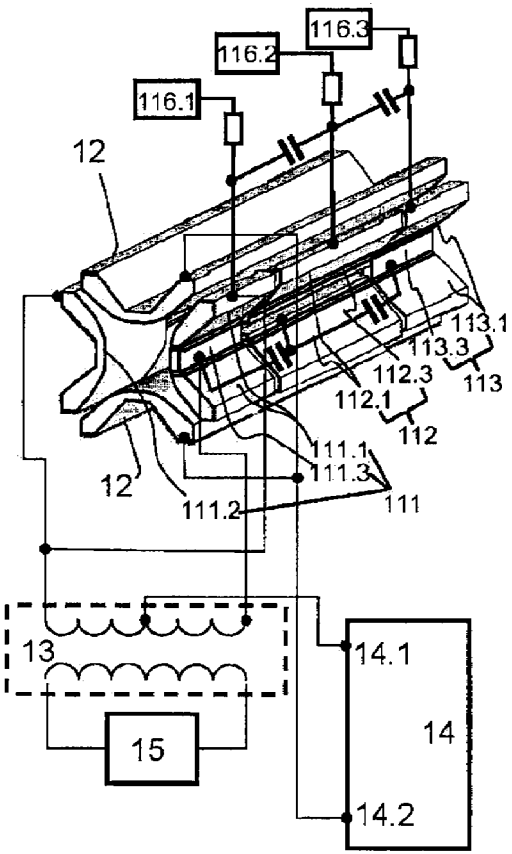
FIG. 9*b* is a circuit structure diagram of a method of dividing, in at least one direction perpendicular to the ejection direction, at least a part of confining electrodes in the direction of the ejection outlet into multiple parts in a multi-segment two-dimensional linear ion trap, applying DC and RF trapping voltages of different amplitudes between these parts, and applying inverted excitation voltages on a confining electrode part near the outlet and other confining electrode parts nearby according to another embodiment of the present invention.
Figure 9A:
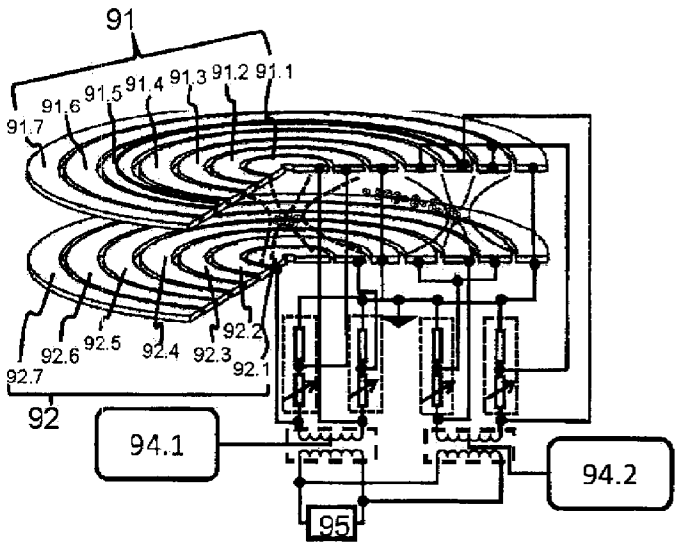
FIG. 9*a* is a circuit structural diagram of a method of dividing, in at least one direction perpendicular to the ejection direction, at least a part of confining electrodes in the direction of the ejection outlet into multiple parts in a planar multi-ring ion trap, applying DC and RF trapping voltages of different amplitudes between these parts, and applying inverted excitation voltages on a confining electrode part near the outlet and other confining electrode parts nearby according to another embodiment of the present invention.

FIG. 9*a* shows a planar multi-ring ion trap, which includes two confining electrode groups 91 and 92, and are divided into multiple electrode bands 91.1, 91.7, 92.1, and 92.7 in a direction perpendicular to the ejection direction, that is, in a disk radial direction, where an RF trapping voltage output by an RF power supply 94.1 is directly applied on the disk electrode parts 91.1 and 91.2 at the ejection outlet in the middle, attenuated by a voltage division attenuator relative to the alternating ground potential, and applied on adjacent parts 91.2 and 92.2 away from the ejection outlet. Excitation voltages applied between the upper and lower disks are both inverted between 91.1 and 91.2, and between the 92.1 and 92.2. Therefore, the orientation of the alternating excitation electric field induced by the excitation voltage is improved, and the mass spectrum performance is improved when this storage area is used as a mass analyzer. Similarly, an RF trapping voltage output by an RF power supply 94.2 is directly applied on a ring trapping electrode band 91.5 which is provided with a ring outlet slot, and a counter electrode 92.5 thereof, attenuated by the voltage voltage-dividing attenuator, and applied on adjacent parts 91.4, 91.6, 92.4, and 92.6 away from the ejection outlet. Likewise, excitation voltages applied between the upper and lower disks are inverted between 91.5 and its two adjacent bands 91.4 and 91.6, and between 92.5 and its two adjacent bands 92.4 and 92.6. This also improves the mass spectrum performance when the ring-like storage area is used as a mass analyzer.

When the trapping voltage is adjusted, an ion exchange process may occur between these different ion storage areas. Such process can be implemented more easily in a multi-segment two-dimensional linear ion trap shown in FIG. 9*b*. In prior patent documents, a linear ion trap is divided into three segments from front to rear, so as to reduce the resonant frequency shift of the middle segment caused by the fringing field. In this method, we only divide a confining electrode pair 11 in the ejection direction into three segments, for example, 111, 112, and 113, along a direction perpendicular to the ejection direction, for example, along the direction of the central axis, and, in the ejection direction, further divide these segments into a group near the ejection outlet part, for example, 111.3-112.3-113.3, and a group away from the ejection outlet part, for example, 111.1-112.1-113.1, and apply alternating excitation voltages of different phases on the two groups. For example, a voltage having the same phase as the alternating excitation power source 15 is applied on the group 111.3-112.3-113.3, while a voltage that is inverted to the power source 15 is applied on the other group 111.1-112.1-113.1, and this inverted excitation voltage is also applied on an electrode, for example, 111.2, opposite the ejection outlet side, thereby forming an excitation electric field with desirable orientation in the ejection direction. The DC bias of each storage space segment can be applied by a bias DC power supply group 116.1-116.2-116.3. FIG. 9*b* shows a circuit relationship, and does not show other end electrode structures at the end 111 and the end 113. In actual working, for example, a DC bias of +10V is applied on 116.1 and 116.3, and a DC bias of −10V is applied on 116.2, and therefore positive parent ions in a highly charged state can be stored in 116.2, while negative ions used for charge transfer and dissociation are introduced and stored in 116.1 and 116.3. When charge transfer and dissociation need to be performed on the stored parent ions, the DC biases applied on the 116.1, 116.2, and 116.3 are uniformly set to 0V, so that positive and negative ions in different storage areas can be mixed to initiate a charge transfer process, thereby breaking parent ions. When a tandem spectrometry needs to be obtained, output voltages of 116.1 and 116.3 are restored to +10V, so as to use the previous inverted excitation electric field to improve the ejection feature in the scanning process, thereby obtaining a high-quality spectrogram.

Fifth Embodiment

Figure 10:
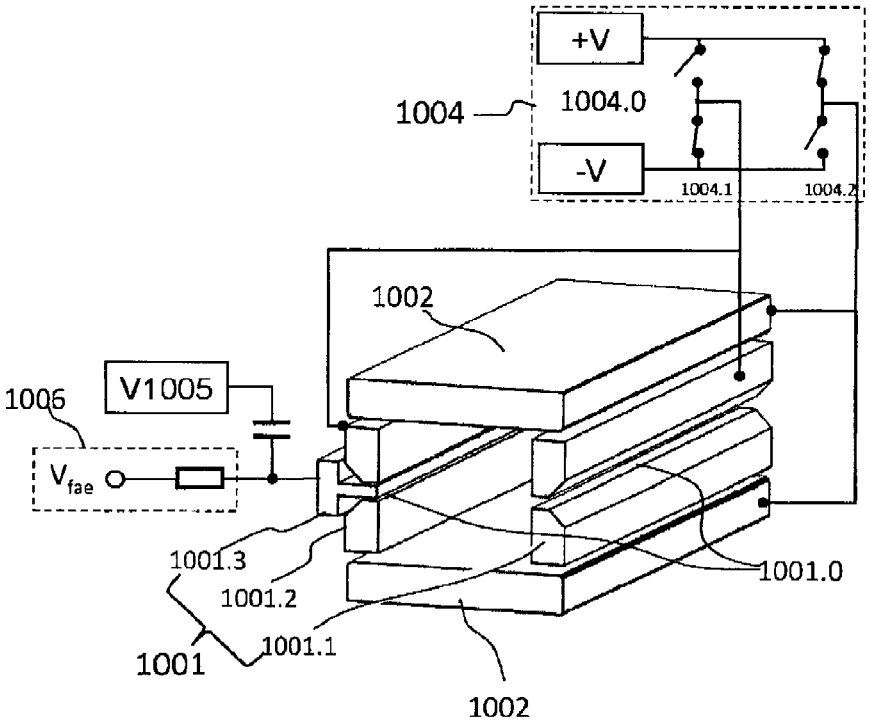
FIG. 10 is a circuit structure example of a method for driving a digital ion trap by using a rectangular switching voltage according to another embodiment of the present invention, where an excitation voltage is only applied on a field adjustment electrode disposed in an ion ejection direction and closest to an opening of the ion trap.

Another method for improving the performance of the mass scanning process is to introduce the so-called field adjustment electrode. For clarity and brevity, FIG. 10 shows a middle segment of a linear ion trap that includes a field adjustment electrode, where the front and rear segments or the front and rear end caps are omitted. High-frequency drive voltages inverted to each other are separately applied on two pairs of main electrodes 1001 and 1002 in a direction perpendicular to the ejection direction, so as to form a trapping electric field.

To improve a mass-to-charge ratio range of the ion trap mass analyzer in the present invention, we use a digital square wave to drive a linear ion trap in this embodiment. When the drive voltage of the ion trap is a digital square wave, the drive trapping square wave power supply 1004 is formed by a high-voltage DC power supply pair 1004.0 and a switch pair 1004.1 and 1004.2 that are connected by a circuit.

The high-voltage DC power supply pair 1004.0 outputs two high-voltage signals whose voltages are +V and −V, respectively. The pair of switches 1004.1 and 1004.2 that are inverted to each other are reversely open/closed in turn under the control of an external circuit to generate two square-wave voltages inverted to each other and with a voltage zero-peak value of V. According to the mass-to-charge ratios of analyzed ions or charged ions, the frequency of the square-wave voltage can be adjusted between 100 MHz and 1 Hz.

In this embodiment, there are two outlet slots 1001.0 in the ion ejection direction, and an outlet slot in the branch electrode 1001.2 is provided with a field adjustment electrode 1001.3. In the mass spectrometry analysis process, the voltage on the field adjustment electrode is set to be a proportional voltage (the proportion may be 0) of a high-frequency voltage $V_{1a}$ on an adjacent branch electrode 1001.2 overlaid with a DC voltage $V_{DC}$, that is:

$$V_{fae}=cV_{1a}+V_{DC}\ 0\leq c\leq 1$$

where the shape of the field adjustment electrode 1001.3 is merely for easy installation, and the specific shape thereof is not limited.

Generally, for a linear ion trap, an AC excitation voltage 1005 needs to be coupled by a band-pass transformer to confining electrodes such as 1001.1 and 1001.2 of the linear ion trap on which the high-voltage trapping voltage has been applied; otherwise, 50% of the RF electric field intensity will be lost. The introduction of the coupling transformer makes the circuit more complex.

However, in a special case where the proportion parameter c is 0 in this embodiment, only one coupling capacitor may be used to directly couple the excitation alternating voltage to an output end of a bias power supply of the high-resistance field adjustment electrode, while no excited alternating voltage signal is applied on other confining electrode parts such as 1001.1 and 1001.2 in the ion ejection direction. In this case, the design for outputting 1005 from the power supply can be changed from the original current output type to a voltage output type, which significantly lowers the complexity of the power supply and reduces the power consumption thereof.

Generally, in this case, the field adjustment electrode is substantially flush with the adjacent cylindrical electrodes on the trapping space side, and the ratio of $V_{DC}$ to the peak value of $V_{1a}$ should be between 0 and 5%. In a general forward mass selection scanning process, because the field adjustment electrode has a high DC voltage, a part of positive ions that are possibly ejected from the left side (and hit the wall) are more likely to be reflected by the field adjustment electrode; therefore, more ions are ejected towards the direction of electrode X on the right side via the ejection slot, and the unidirectional ejection efficiency of ions is improved.

In a parent ion isolation process, a voltage bias lower than those of other confining electrodes may be applied on the field adjustment electrode. In this case, for each ion ejection event of positive ions in a mass-to-charge ratio range to be excluded, the ions are more likely to be ejected towards the field adjustment electrode. Therefore, bombardments of these impurity ions on detectors can be reduced, and a short-term increase effect of a background current during a post mass spectrometry analysis process caused by the accumulation of residuals on other parts in the trap and on detectors can be reduced, thereby improving the relative sensitivity of the post mass analysis process. In this process, the alternating excitation voltage is a non-single-frequency discrete-frequency or continuous-frequency combined signal, used to eject ions of a specified mass-to-charge ratio or in a specified mass-to-charge ratio range. Further, a continuous-frequency combined signal with a frequency gap may be used to excite ions, so as to retain ions with some specific mass-to-charge ratio in a mass-to-charge ratio range, and eject other ions.

In addition, a high-order DC multi-pole field component may be generated in the ion trap by adjusting the DC bias of the field adjustment electrode. Alternatively, the DC bias voltage changes periodically with a low frequency such as 100 Hz or 20 KHz. All these methods can achieve DC excitation to retain ions in some specific mass-to-charge ratio ranges, and effectively excite and dissociate the ions.

Sixth Embodiment

All the mass analyzer examples described in the foregoing embodiments belong to the same ion trap mass analysis method. The method includes the following steps:

First, for a mass analysis apparatus of an ion trap type, ions generated in the trap or injected from outside the trap are trapped in the ion trap by applying a DC or an RF trapping voltage.

Then, in the mass analysis process, our analysis method uses a particular excitation frequency of ions with a specific mass-to-charge ratio, and therefore, in this analysis process, the electric field in the ion trap needs to be maintained as or changed to be a quadratic trapping electric field in the direction of the ejection outlet, so that the motion form of ions in this direction is vibration motion similar to that in a simple harmonic potential trap and mainly with a single frequency.

To improve the ion ejection characteristic during resonant excitation, first an AC excitation voltage is first overlaid between a confining electrode part near the ejection outlet and other confining electrode parts. Generally, for an RF ion trap, the frequency of the excitation voltage is between 1 KHz and 2 MHz, and is lower than the frequency of the RF trapping voltage. In this way, an alternating excitation electric field can be applied in the direction of the ejection outlet. At other confining electrode parts not near the ejection outlet in the direction of the ejection outlet, no AC current having the same phase as said AC excitation voltage is applied. Therefore, by limiting the space where the excitation voltage is applied on the confining electrode, the orientation of the alternating excitation electric field is improved.

After that, the intensity of the trapping electric field or the intensities or frequencies of the trapping electric field and the alternating excitation electric field may be scanned, so as to change overall motion frequencies, that is, secular motion frequencies, of the trapped ions in the direction of the ejection outlet, so that the secular motion frequencies sequentially coincide with the frequency of the alternating excitation electric field in the direction of the ion ejection outlet according to values of mass-to-charge ratios, thereby achieving high-efficient resonant ejection in the direction of the ejection outlet, reducing motion coupling with other motion directions, and obtaining a mass spectrum signal with desirable resolution on the detector.

Figure 11:
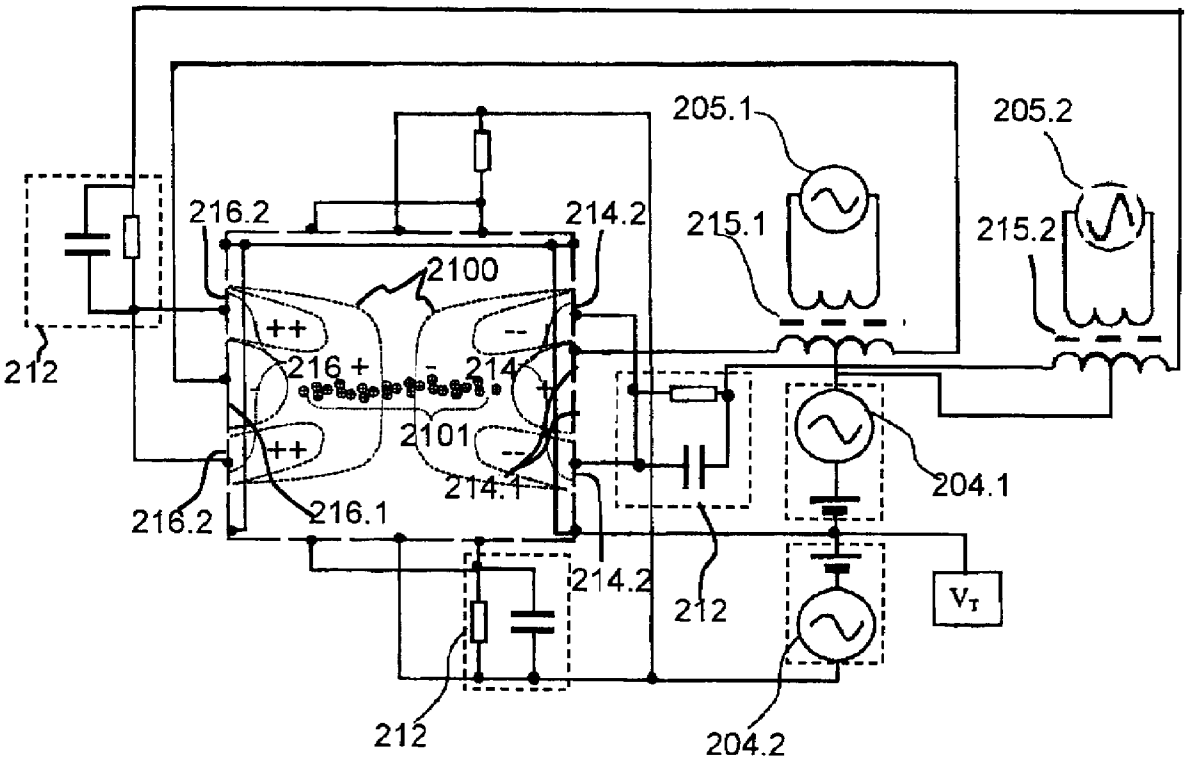
FIG. 11 is a schematic circuit diagram for setting a trapping voltage and an excitation voltage of each confining electrode by using a common power supply and a voltage attenuator relative to a DC reference potential, and applying inverted excitation voltages on other parts except the ejection outlet part by using the confining electrodes to reduce the escape loss of ions during an excitation and dissociation process.

In this method, alternating voltage signals inverted to the alternating voltage signal which is applied on the confining electrode at the ejection outlet part and used for resonant excitation may further be applied, through a voltage-dividing capacitor voltage attenuator 211 shown in FIG. 8 or a resistor-capacitor voltage attenuator 212 shown in FIG. 11, on electrode structure parts other than the part near the ejection outlet in the confining electrode group in the direction of the ejection outlet. In this way, the orientation of the excitation alternating electric field can further be improved by using a reverse excitation voltage area generated by the inverted alternating voltage, thereby improving the mass resolution capability of the method. It should be noted that, when a resistor-capacitor attenuator is used to attenuate the excitation voltage, the reference potential $V_T$ of the attenuator not only can be a ground potential, but also can be a preset DC reference potential, so that a DC bias component can be overlaid on the excitation alternating electric field, which is beneficial for ion ejection.

Finally, it should be noted that, this solution can also be used in a reverse manner so that when target ions to be analyzed are broken in the resonant excitation process, it becomes not easy for the target ions to flow out of the ion trap but maintain large vibration amplitude. The apparatus for implementing this method is shown in FIG. 11, and includes the following steps:

trapping ions produced in the ion trap or injected from outside the ion trap; and maintaining an electric field in the ion trap as or change it to be a quadratic trapping electric field in a direction of an ejection outlet.

The key of this method lies in that, after the trapping electric field is implemented, with the circuit shown in FIG. 11, two excitation alternating voltage sources 205.1 and 205.2 that are inverted to each other may be used to overlay AC excitation voltages that are inverted to each other between the confining electrode part, for example, 211.1, near the ejection outlet of the ion trap and other confining electrode parts, for example, 216.1, to apply an alternating excitation electric field in the direction of the ejection outlet. At the same time, in the direction of the ejection outlet, an AC voltage having a phase different from that of the AC excitation voltage is applied on other confining electrode parts, for example, 214.2, not near the ejection outlet. Generally, the main excitation voltage corresponds to the voltage of the middle electrode 214.1, and in this case, the ejection orientation of the excitation electric field along the direction of the ejection outlet is improved. However, when the output amplitude of the alternating voltage source 205.2 is far greater than the output amplitude of the alternating power supply source 205.1, for example, more than three times of the output amplitude of 205.1, the polarity direction of the dipole excitation electric field at the center of the ion trap is switched, as shown by the polarity of the equipotential line 2100. Herein, the main and quadratic excitation voltages are switched, the in-phase excitation potential applied on the electrode near the ejection outlet substantially changes to be a blocking potential, which inhibits the motion directly along the ejection direction, and the motion range of resonant amplification ions increases. Therefore, by controlling the composition of intensities and frequencies of the trapping electric field and the alternating excitation electric field, the frequency of the motion component, along the direction of the ejection outlet, of ions in a certain mass-to-charge ratio range coincides with one of the frequency components of the alternating excitation electric field in this direction; therefore, the vibration amplitude and mean kinetic energy of ions in the target mass-to-charge ratio range in this direction are increased in a certain quadratic field coordinate range 2101 in the long term, so that the ions collide with collision gas molecules introduced into the ion trap for dissociation into fragmented ions.

The key to success in this mode is applying an auxiliary excitation voltage, which is different from the excitation voltage applied on the confining electrode part at the ejection outlet, on electrode parts other than the confining electrode part at the ejection outlet to excite ions. Therefore, in the motion mode of the target ion group, the number of ions moving along the plane or axis of the ejection outlet is reduced, thereby reducing the loss caused by the ion escape via the ejection outlet, and improving the overall efficiency of the dissociation process.

The foregoing merely provides an improved ion trap mass analysis device implemented by limiting an applying range of an excitation alternating voltage to change ion motion, and functions thereof. In fact, anyone familiar with the working principle of the ion trap can make other modifications. In addition, in the foregoing embodiment, the confining electrodes on which a trapping voltage is applied along the direction of the ejection outlet are generally divided into two parts, namely, a part near the ejection outlet and a part away from the ejection outlet ejection outlet, and actually a structure of multiple divided parts can also be used, in which the applying range of the excitation alternating voltage is only limited on at least one part of electrodes. In the same way, the design idea of the ion trap mass analysis apparatus of the present invention can also be used in a multi-mass analysis channel array which is formed by simple combination and reuse of some electrode components of a single ion trap apparatus. In use of the field adjustment electrode, the pattern of the fringing field may also be adjusted segment by segment. The field adjustment electrode only needs to be located in one part of the ion trap mass analyzer units, but does not need to extend throughout the whole mass analyzer structure in possible perpendicular directions of the quadratic field. Multiple field adjustment electrodes may be used to implement ion excitation in some direction, or implement direction-selective ion excitation in multiple directions. The ion trap or ion storage structure that includes a quadratic field in the present invention is not limited to a constant ideal quadratic electric field structure, such as a two-dimensional quadrupole field, a three-dimensional rotating quadrupole field, a quadratic logarithmic field, and so on, and may also be an uneven substantial quadratic electric field structure that fluctuates, bends, or curves at a certain degree, as long as the basic mass spectrometry analysis function is not affected and the structure has characteristics of a substantial quadratic electric field during resonant excitation ejection or resonant excitation dissociation. All ion analysis methods that implement multi-cycle ion reciprocation motion under the effect of a quadratic field in areas such as a reflector area in a mass analyzer with a single reflective time of flight, or all or a part of areas of multiple reflective times of flight, or in a magnetic cyclotron resonance apparatus, and implement resonance amplitude excitation by using the content in the claims of the present invention fall within the scope of the present invention. In addition, apparatuses and analysis methods produced by combining the apparatus and method of the present invention with other mass spectra and other analysis methods shall also fall within the scope of the present invention.

What is claimed is:

1. An ion trap analyzer, comprising:

multiple confining electrodes, an ion trapping space enclosed by the multiple confining electrodes, a voltage source configured to apply a trapping voltage to at least one confining electrode of the multiple confining electrodes, so as to generate a trapping electric field in the ion trapping space, at least one ion ejection outlet provided on a side of the ion trapping space, the ion ejection outlet defining an ion ejection direction, and an excitation voltage source, wherein confining electrodes on the same side of the ion trapping space as the ion ejection outlet are divided into multiple electrode parts in a direction perpendicular to the ion ejection direction, wherein the voltage source is further configured to overlay at least one of in-phase alternating trapping voltages or DC trapping voltages on the multiple electrode parts so as to form a substantially quadratic trapping electric field in the ion ejection direction, and wherein the excitation voltage source is configured to overlay an alternating voltage signal whose amplitude is less than or equal to a maximum absolute value of the trapping voltage on a first electrode part of the multiple electrode parts, the first electrode part being adjacent to the ion ejection outlet, so as to select a motion range of ions by means of resonant excitation, and such that no voltage signal having the same phase as said alternating voltage signal is applied on a second electrode part of the multiple electrode parts except the first electrode part, and wherein the excitation voltage source is further configured to overlay an alternating voltage signal inverted to the alternating voltage signal on the second electrode part.

2. The ion trap analyzer according to claim 1, wherein the voltage source is further configured to overlay the in-phase alternating trapping voltages on the first electrode part and the second electrode part, respectively.

3. The ion trap analyzer according to claim 1, further comprising a power supply, wherein the power supply is configured to apply, on another confining electrode which is in a direction substantially opposite the first electrode part and is located on a side different from the ion ejection outlet, an alternating voltage signal inverted to said alternating voltage signal, so as to generate a dipole alternating excitation electric field in a positive direction and a negative direction of the ion ejection outlet.

4. The ion trap analyzer according to claim 1, further comprising a power supply, wherein the power supply is configured to apply, on another confining electrode which is in a direction substantially opposite the first electrode part and is located on a side different from the ion ejection outlet, an alternating voltage signal having the same phase as said alternating voltage signal, so as to generate a quadrupole alternating excitation electric field in a positive direction and a negative direction of the ion ejection outlet.

5. The ion trap analyzer according to claim 1, wherein the ion trap analyzer is a linear ion trap of which the trapping electric field is a two-dimensional quadrupole trapping electric field.

6. The ion trap analyzer according to claim 5, wherein the ion ejection outlet comprises an ejection slot perpendicular to an axial direction of the two-dimensional quadrupole trapping electric field.

7. The ion trap analyzer according to claim 5, wherein the ion ejection outlet comprises an ion ejection outlet on at least one side of an axial direction of the two-dimensional quadrupole trapping electric field.

8. The ion trap analyzer according to claim 1, wherein the ion trap analyzer is a static ion trap of which the trapping electric field is a one-dimensional quadratic trapping electric field.

9. The ion trap analyzer according to claim 1, wherein the ion trap analyzer is a three-dimensional ion trap of which the trapping electric field is a rotating quadrupole electric field.

10. The ion trap analyzer according to claim 1, further comprising a common power supply unit, wherein the common power supply unit is configured to apply a common voltage signal on the first electrode part and the second electrode part.

11. The ion trap analyzer according to claim 10, wherein the common power supply unit further comprises a voltage attenuator, and the voltage attenuator is configured to attenuate the common voltage signal applied on the second electrode part relative to a DC reference potential.

12. The ion trap analyzer according to claim 1, wherein the trapping voltage is a digital voltage having a frequency of 1 Hz to 100 MHz.

13. The ion trap analyzer according to claim 1, wherein the alternating voltage signal is a combined voltage signal of non-single-frequency discrete voltage signals or voltage signals of continuous frequencies.

14. The ion trap analyzer according to claim 1, further comprising a field adjustment electrode inserted in the ion ejection outlet, wherein the field adjustment electrode is located in the ion ejection direction, and is outside of the trapping space;

and in the multiple electrode parts, the alternating voltage signal is only applied on the field adjustment electrode.

* * * * *